US007162851B2

(12) United States Patent
Yoshida et al.

(10) Patent No.: US 7,162,851 B2
(45) Date of Patent: Jan. 16, 2007

(54) METHOD FOR CHANGING A STOPPER

(75) Inventors: Eiji Yoshida, Tokyo (JP); Keiichi Yahagi, Tokyo (JP); Hiroyuki Matsunaga, Tokyo (JP); Satoshi Otake, Tokyo (JP); Hiroki Matsumoto, Tokyo (JP); Tatsuro Ishimatsu, Tokyo (JP); Yusuke Yoshida, Tokyo (JP); Kagenori Nagao, Tokyo (JP); Satomi Kudo, Tokyo (JP); Eri Kawaguchi, Tokyo (JP); Ikuo Andreas Nakayama, Tokyo (JP); Yuta Ogino, Tokyo (JP); Syotaro Nakajima, Tokyo (JP)

(73) Assignee: Eiji Yoshida, Tokyo (JP)

( * ) Notice: Subject to any disclaimer, the term of this patent is extended or adjusted under 35 U.S.C. 154(b) by 0 days.

(21) Appl. No.: 11/125,519

(22) Filed: May 10, 2005

(65) Prior Publication Data

US 2005/0204704 A1 Sep. 22, 2005

Related U.S. Application Data

(62) Division of application No. 10/493,815, filed as application No. PCT/JP03/06490 on May 23, 2003, now Pat. No. 7,032,364.

(30) Foreign Application Priority Data

May 23, 2002 (JP) ..... 2002-149117

(51) Int. Cl.
*B65B 31/02* (2006.01)
*B67B 1/00* (2006.01)

(52) U.S. Cl. ..... 53/432; 53/403; 53/468; 53/489; 53/86; 53/109; 53/264

(58) Field of Classification Search ..... 53/432, 53/478, 485, 510, 79, 86, 403, 468, 264, 53/306, 308, 319, 381.4, 109, 418, 489
See application file for complete search history.

(56) References Cited

U.S. PATENT DOCUMENTS 3,699,740 A * 10/1972 Knabe ..... 53/432
4,374,464 A 2/1983 Tillander
4,467,846 A * 8/1984 Croser ..... 141/47

(Continued)

FOREIGN PATENT DOCUMENTS

DE 4107567 9/1992

(Continued)

*Primary Examiner*—Christopher R. Harmon
(74) *Attorney, Agent, or Firm*—Duane Morris, LLP

(57) ABSTRACT

A stopper change device (10) includes an airtight chamber body (21) detachably mountable on a head of a bottle, a gas supply port (19) for supplying N gas to the chamber body, an air vent valve (57) for discharging air from the chamber body, a first supporting structure (28) movable upward and downward for supporting a corkscrew, and a second supporting structure (34) movable upward and downward for containing a substitute stopper. The first and second supporting structures are mutually position changeable, and one of them is selectively placed above an opening of the bottle. When the first supporting structure (28) is placed above the opening, a bottle stopper can be pulled in N gas atmosphere. On the other hand, when the second supporting structure (34) is placed above the opening, the substitute stopper is mountable on the head of the bottle in N gas atmosphere. By changing the bottle stopper with the substitute stopper using this device, entering of air in the bottle as a cause of deterioration in a quality can be prevented.

19 Claims, 17 Drawing Sheets

U.S. PATENT DOCUMENTS 4,475,576 A * 10/1984 Simon ..... 141/98
4,655,029 A * 4/1987 Weiss ..... 53/432
5,012,703 A * 5/1991 Reinbacher ..... 81/3.29
5,038,548 A * 8/1991 Sieg ..... 53/431
5,299,408 A * 4/1994 Dupont ..... 53/432
5,458,165 A * 10/1995 Liebmann, Jr. ..... 141/64
6,026,867 A * 2/2000 Klarl ..... 141/91
6,736,172 B1 * 5/2004 Chetaille et al. ..... 141/177

FOREIGN PATENT DOCUMENTS

FR 2650816 2/1991
GB 2322851 9/1998

* cited by examiner

FIG. 16a
FIG. 16b
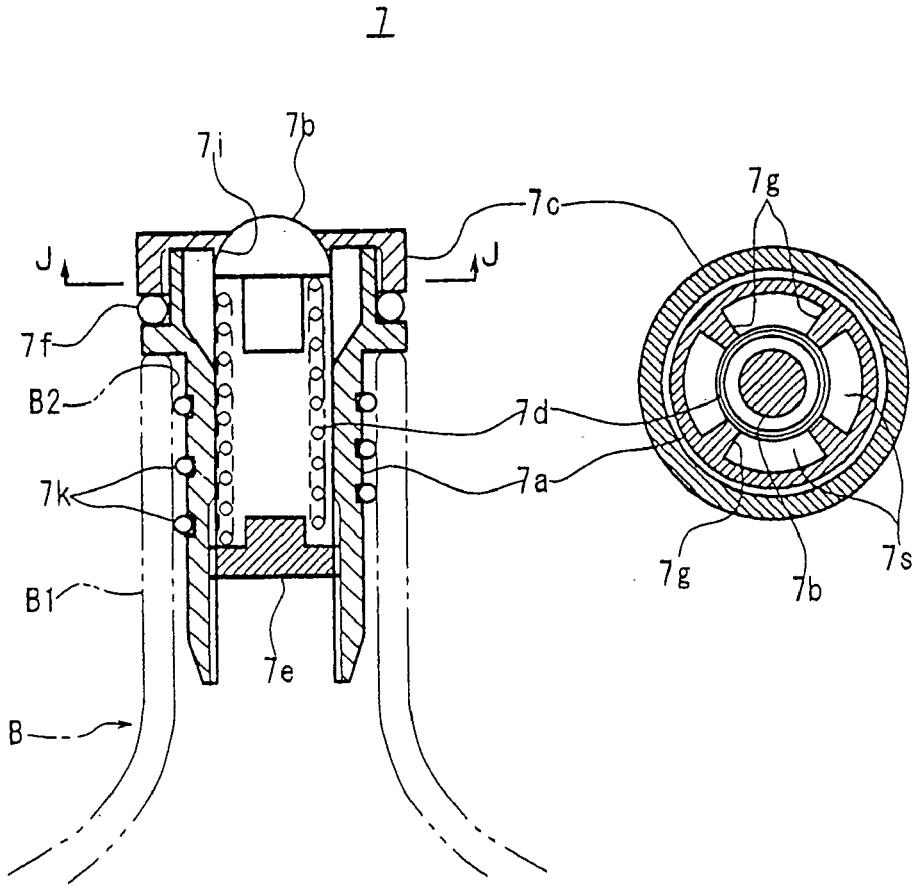
FIG. 16c
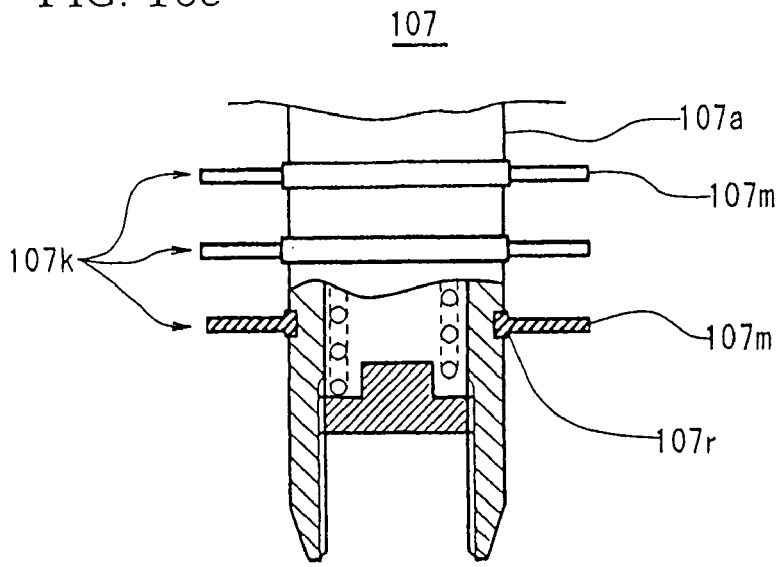

METHOD FOR CHANGING A STOPPER

CROSS-REFERENCE to RELATED APPLICATIONS

This is a divisional application of U.S. nonprovisional application Ser. No. 10/493,815, filed Apr. 28, 2004, now U.S. Pat No. 7,032,364, granted Apr. 25, 2006, by Eiji Yoshida et al., titled "Plug Replacing Device and Plug Replacing Method," which is a U.S. national phase entry of PCT application, PCT/JP03/06490, filed May 23, 2003, and which claims priority to Japanese national application 2002-149117, the entirety of which applications are incorporated herein by reference.

TECHNICAL FIELD

The present invention relates to a device for changing a bottle stopper and a method for changing a bottle stopper for changing a sealing stopper of a bottle with fluid such as wine and so on contained therein with a substitute stopper in place of the sealing stopper. To be more specific, the present invention relates to the device for changing the bottle stopper and the method for changing the bottle stopper capable of changing while supplying gas (deterioration preventive gas), which has as a main purpose for preventing deterioration in liquid such as wine and so on.

BACKGROUND ART

Recent popularization of wine is nothing short of eye opening, and brands, producing areas, kinds, tastes, and the like of the wine are diversified with the popularization of wine. This trend, for example, promotes opening business of a bar specializing in wine, which is so-called a wine bar, and a large variety of wines corresponding to customers' tastes have been offered at such a wine bar. This type of the wine bar, for example, offers a small amount of free samples among various brands of wines in order for customers to choose a wine of their tastes among the large variety of wines, or sells the wine by weight to the customers who want to purchase the wine in a glass unit, and therefore, many bottles need to be opened at the same time. However, since air enters the bottle once opened, deterioration of wine is inevitable when there is leftover wine in the bottle even though this problem does not happen when wine is drunk up. When leftover wine after opening the bottle deteriorates to a certain extent after a certain amount of time passes, there is no other choice but to throw leftover wine out. This is a waste of wine.

As a means for avoiding such an inconvenience, a liquid preserving device having a structure described below has been proposed (Japanese Patent Laid-open No. 2001-354206). This device has such a purpose that air in the bottle is inhaled by a vacuum pump through a pressure-reducing stopper installed on an opening of the bottle so that the deterioration of wine remaining in the bottle can be prevented.

In addition, an applicant of the present invention previously proposed a wine extracting device having such a structure that the device is mounted on an opening of the bottle, and that the bottle is opened while supplying insoluble inert gas with the opening of the bottle positioned downward, and consequently only a necessary amount of wine is extractable by gas pressure thereof (Japanese Patent Laid-open No. 2001-122397).

However, according to the aforementioned liquid preserving device, an existing bottle stopper must be opened in air in order to install the pressure-reducing stopper as a substitute stopper. Accordingly, air enters the bottle when opening the bottle stopper. Consequently, oxidation of the remaining wine by the entered air, that is, deterioration in a quality of wine, is inevitable.

Furthermore, the aforementioned wine-extracting device relating to the proposal of the applicant of the present invention is a device for extracting wine from the bottle without oxidizing wine by using insoluble inert gas, and not a device for changing the bottle stopper with the substitute stopper like the pressure-reducing stopper.

An object of the present invention is to provide a device for changing a bottle stopper and a method for changing a bottle stopper capable of changing the existing bottle stopper with the substitute stopper without allowing air to enter the bottle with fluid contained therein. In passing, the fluid includes not only liquid such as wine, carbonated water, and so on, but also overall fluid such as lactic acid bacteria beverage, fruit juice with pulp, fluid having a large fluid resistance such as edible oil, and so on.

DISCLOSURE OF THE INVENTION

In order to achieve the aforementioned object, the present invention provides a structure explained below. It should be noted that definitions or the like of terminologies for explaining any of the inventions might be applied to other inventions within a possible range of a nature. Furthermore, a description of "a first" and "a second" in the specification is only for convenience of explanation and does not specify either.

A device for changing a stopper relating to a first invention is a device for exchanging a bottle stopper which closes an opening of a head of a bottle with fluid contained therein, for a substitute stopper mountable on the opening, the device for changing the stopper comprising: an airtight container detachably mountable on the head of the bottle via an airtight mounting mouth; a gas supply port provided on the airtight container for supplying deterioration preventive gas to the airtight container; an air vent valve provided on the airtight container for discharging air from the airtight container; a first supporting structure for supporting a bottle opening member for detaching the bottle stopper in an airtight chamber, the first supporting structure being movable upward and downward while holding airtight in the airtight chamber; a second supporting structure for mounting the substitute stopper contained in the airtight chamber in a standing position on the opening of the head, the second supporting structure being movable upward and downward while holding airtight in the airtight chamber; and an operation body being operational individually or commonly with the first supporting structure and the second supporting structure, wherein the first supporting structure and the second supporting structure are mutually position changeable between them in order to place the first supporting structure or the second supporting structure above the opening of the head via the airtight mounting mouth while holding airtight of the airtight chamber, and wherein the bottle stopper detached by downward movement of the first supporting structure by means of an operation of the operation body and by a bottle opening operation of the bottle opening member is able to pull in the airtight chamber via the airtight mounting mouth as the first supporting structure moves upward when the first supporting structure is placed above the opening of the head, and wherein the substitute stopper contained in the airtight chamber by the operation of the operation body is mountable on the opening of the head via the airtight mounting mouth as the second supporting structure moves downward when the second supporting structure is placed above the opening of the head.

According to the device for changing the stopper relating to the first invention, by changing a relative position between the first supporting structure and the second supporting structure, the first supporting structure or the second supporting structure can be placed above the airtight mounting mouth, that is, the opening of the head of the bottle. In other words, whether the first supporting structure for supporting the bottle-opening member is positioned or the second supporting structure for supporting the substitute stopper is positioned relative to the opening of the head of the bottle is selectable. Furthermore, since the device allows the bottle stopper to be changeable without deterioration in a quality of fluid such as wine and so on by blocking a contact of fluid in the bottle with air even after opening the bottle, supply of deterioration preventive gas is inevitable. Accordingly, installation of the gas supply port communicating with a gas passage is necessary. With this, by providing the air vent valve, existent air as a cause of deterioration in the quality in the airtight chamber is changeable with deterioration preventive gas. Furthermore, the operation body can operate the first supporting structure or the second structure, and this operation makes opening the bottle by the bottle opening member or mounting the substitute stopper possible.

A device for changing a stopper relating to a second invention is a device for changing a bottle stopper which closes an opening of a head of a bottle with fluid contained therein with a substitute stopper mountable on the opening, the device for changing the stopper comprising: a holder body including a holding portion having a recessed portion with an upper opening, a tubular mounting mouth mountable on an outer peripheral face of the head of the bottle in an airtight state, and a through hole through which the recessed portion and a fitting hole of the tubular mounting mouth are communicable, and through which the bottle stopper and the substitute stopper are passable; a moving table being able to form a gas passage in the recessed portion by laying on the holding portion and closing the recessed portion, and including a communication hole through which the bottle stopper and the substitute stopper are passable; a gas supply port with which the gas passage is communicable and from which deterioration preventive gas is able to be supplied; a moving table supporting structure for supporting the moving table to be at least mutually position changeable relative to the holder body between a first position and a second position as a position other than the first position while holding airtight of the gas passage; a chamber body positioned on the moving table and including an airtight chamber communicating with the gas passage via the communicating hole; an air vent valve from which air in the airtight chamber is dischargeable; a first supporting structure for supporting a bottle opening member for detaching the bottle stopper in the airtight chamber, the first supporting structure being movable upward and downward while holding airtight in the airtight chamber; a second supporting structure for mounting the substitute stopper contained in the airtight chamber in a standing position on the opening of the head, the second supporting structure being movable upward and downward while holding airtight in the airtight chamber; and an operation body being operational the first and the second supporting structures, the operation body being able to be coupled selectively and detachably to the first supporting structure or the second supporting structure, wherein the bottle stopper detached by downward movement of the first supporting structure and by rotation of the bottle opening member is able to pull in the airtight chamber via the through hole and the communicating hole as the first supporting structure moves upward when the moving table is moved to the first position and when the operation body coupled to the first supporting structure is operated, and wherein the substitute stopper contained in the airtight chamber is able to insert in the opening of the head via the through hole and the communicating hole as the second supporting structure moves downward when the moving table is moved to the second position and when the operation body coupled to the second supporting structure is operated.

According to the device for changing the stopper relating to the second invention, the holder body, the moving table, and the moving table supporting structure constitute a base having the gas passage. The moving table is so structured that, by moving, the first supporting structure and the second supporting structure installed in the airtight chamber provided on the moving table are movable so as to allow position change at least between the first position and the second position. By moving the moving table, whether the first supporting structure for supporting the bottle opening member is positioned or the second supporting structure for supporting the substitute stopper is positioned against an opposite face of the opening of the bottle being the first position is selectable.

Furthermore, since the device allows the bottle stopper to be changeable without deterioration in a quality of fluid such as wine and so on by blocking a contact of fluid in the bottle with air even after opening the bottle, supply of deterioration preventive gas is inevitable. Accordingly, installation of the gas supply port communicating with the gas passage is necessary. With this, by providing the air vent valve, existent air as a cause of deterioration in the quality in the gas passage and in the airtight chamber is changeable with deterioration preventive gas. Furthermore, the operation body is selectively and detachably coupled to the first supporting structure or the second supporting structure to move it, and makes opening the bottle by the bottle opening member or mounting the substitute stopper possible.

A device for changing the stopper relating to the third invention is the device for changing the stopper according to the first invention, wherein the chamber body is structured with a first airtight tower including a first airtight chamber and a second airtight tower including a second airtight chamber, and wherein the communicating hole is structured with a first communicating hole communicating the first airtight chamber with the gas passage and a second communicating hole communicating the second airtight chamber with the gas passage, and the first communicating hole can pass at least the bottle stopper and the second communicating hole can pass at least the substitute stopper. Since the respective supporting structures can be contained in the airtight chambers by separating the airtight chamber into two, the entire device can be downsized and an amount of consumption of deterioration preventive gas can be reduced.

The chamber body is a base for installing the respective airtight chambers, and may be integrally structured with the moving table or may be structured with a different member. However, the respective airtight chambers are communicable with the gas passage via the respective through holes, thereby allowing deterioration preventive gas to be filled up. In addition, the respective supporting structures are provided in the respective airtight chambers, and the respective supporting structures are positioned by moving the airtight towers together with the moving table. The chamber body allows downsizing the entire device and reducing the amount of consumption of deterioration preventive gas to be promoted.

A device for changing the stopper relating to a fourth invention further comprises a coupling assist, wherein the coupling assist includes a packing disposed between an inner peripheral portion of the mounting mouth and an outer peripheral portion of the head of the bottle. The device for changing the stopper allows change of the stopper while blocking entering of air in the bottle, and therefore, it is necessary to hold an airtight state also between the device for changing the stopper and the bottle. As a means for holding the airtight state, the packing is disposed between the inner peripheral portion of the mounting mouth and the outer peripheral portion of the bottle. Any packing is acceptable as long as it holds between the head of the bottle and the inner peripheral portion of the mounting mouth of the device in a sealed state.

In a device for changing the stopper relating to a fifth invention, the coupling assist further comprises a coupling nut capable of screwing with a thread groove formed on an outer peripheral face of the mounting mouth, wherein a ring-shaped flange capable of abutting against a bottom end of the packing after screwing on the thread groove is provided on a bottom end of the coupling nut. When the ring-shaped flange abuts against the bottom end of the packing after screwing with the thread groove on the outer peripheral face of the mounting mouth, detachment of the packing is prevented.

In a device for changing the stopper relating to a sixth invention, the moving table is made of a disk body, and the moving table supporting structure supports the moving table to be able to turn or rotate horizontally relative to the holding portion between the first position and the second position. A change of a position of the moving table can be realized by a reciprocating mechanism or other mechanisms, but, here, the moving table is made of the disk body and the moving table supporting structure turns horizontally the moving table. The change of the position of the moving table can be realized by a reciprocating mechanism or other mechanisms, but, here, a turning mechanism is adopted in order to downsize the entire device by making a movable area as small as possible.

In a device for changing the stopper relating to a seventh invention, the moving table supporting structure is structured with a ring-shaped edge portion of the holding portion, an outer peripheral portion lower surface of the moving table capable of abutting against an upper end face of the ring-shaped edge portion, a ring-shaped flange portion extending downward from a position closer to a center of the outer peripheral portion lower surface and being able to fit in the recessed portion, a fixing ring for pushing down the moving table from the top not to detach from the holding portion, and a packing for holding airtight between an inner peripheral face of the ring-shaped edge portion and an outer peripheral face of the flange portion. The moving table supporting structure enables the moving table to make a turning motion on the holding portion, and furthermore, holds the airtight state by the packing. The fixing ring prevents detachment of the moving table and ensures certain turning motion.

In a device for changing the stopper relating to an eighth invention, the first supporting structure includes a first piston moving upward and downward in the first airtight chamber in an airtight state and supporting the bottle opening member to be able to turn at a central portion. The up-and-down movement of the first piston is conducted in an airtight state, and therefore, the airtight in the airtight chamber below the piston is held even if the first piston is moved upward and downward for a bottle opening operation. In addition, a circumstance in which air enters the bottle does not happen even after opening the bottle.

In a device for changing the stopper relating to a ninth invention, the operation body includes a swing lever one end portion of which is supported by the holder body to be able to swing, a lead screw mounted to be able to slide on the swing lever and a connector for selectively connecting the lead screw to the first supporting structure or the second supporting structure. The lead screw is a central member for detaching the bottle stopper or for inserting the substitute stopper by connecting with the first supporting structure or the second supporting structure via the connector. The lead screw and the connector are mounted via the swing lever, and for example, an obstruction is removable by pushing the swing lever down if the airtight tower obstructs during an operation of the change of the position.

In a device for changing the stopper relating to a tenth invention, the operation body includes a clutch mechanism for selecting whether or not a move screws mechanism between the swing lever and the lead screw is formed. Various functions of the lead screw are guaranteed by adopting such the clutch mechanism. In other words, the clutch mechanism is provided for realizing a selection of whether the lead screw slides relative to the swing lever or the lead screw forms a screw pair (a move screw mechanism). For example, when a corkscrew is inserted in a cork, a screw pair is not formed and the corkscrew can insert by a free rotation relative to the swing lever. In addition, when the substitute stopper is mounted on the bottle, the lead screw is rotated by engaging the clutch mechanism and forming the screw pair relative to the swing lever, thereby pushing the substitute stopper contained in the second airtight chamber in a standby state.

In a device for changing the stopper relating to an eleventh invention, the clutch mechanism is a manual clutch including a pair of clutch pieces each of which has a female screw portion at a position corresponding to a male screw portion of the lead screw, a compression spring for biasing the respective clutch pieces in a direction away from the lead screw, and push buttons provided on an outer end portion of the respective clutch pieces. Namely, the clutch mechanism is so structured that, if the pair of push buttons provided on a side of the swing lever is pushed, the screw pair is realized by engaging the female screw portions of the pair of clutch pieces with the male screw portion of the lead screw. As a result, if the lead screw is rotated in a state that the clutch mechanism is engaged, the lead screw can move upward and downward as a move screw.

A device for changing the bottle stopper relating to a twelfth invention is a device for changing a bottle stopper of the bottle with fluid contained therein with a substitute stopper, the device for changing the stopper comprising: an airtight container being detachably mountable on a head of the bottle via an airtight mounting mouth; a gas supply port provided on the airtight container for supplying deterioration preventive gas to the airtight container; an air vent valve provided on the airtight container for discharging air from the airtight container; a bottle opening member contained in the airtight container together with the substitute stopper; and an operating portion capable of operating the bottle opening member from outside in order to detach the bottle stopper, wherein at least a part of the airtight container is made of a flexible member, and wherein the substitute stopper is able to be mounted on the head of the bottle in place of the bottle stopper detached from an outside of the airtight container by using flexibility of the flexible member.

Similar to the device for changing the stopper relating to the aforementioned first invention, the device for changing the stopper relating to the twelfth invention allows the bottle stopper to be changeable without deterioration in a quality of fluid such as wine and so on by blocking a contact of fluid in the bottle with air even after opening the bottle. Therefore, supply of deterioration preventive gas is inevitable. Accordingly, installation of the gas supply port communicating with a gas passage is necessary. With this, by providing the air vent valve, existent air as a cause of deterioration in the quality in the gas passage and in the airtight chamber is changeable with deterioration preventive gas. Furthermore, the operation body is selectively and detachably coupled to the first supporting structure or the second supporting structure to move it, and makes opening the bottle by the bottle opening member or mounting the substitute stopper possible. Furthermore, a user can conduct an operation of mounting and so on of the substitute stopper from the outside of the airtight container since at least a part of the airtight container is made of the flexible member. Accordingly, a structure of the entire device may be extremely simple, and the device can be folded for a compact storage when not in use.

In a device for changing the stopper relating to a thirteenth invention, the bottle opening member is a corkscrew, and the first supporting structure supports the corkscrew to be able to rotate. The cork stopper is able to pull by supporting the corkscrew by means of the first supporting structure to be able to rotate and move upward and downward. The device for changing the stopper is intended for the bottles with various kinds of fluid contained therein, however, easy change of the cork stopper largely used for sealing the wine bottle is emphasized considering many cases that the wine bottle sealed by the cork stopper is a target. Accordingly, the corkscrew is adopted as the bottle-opening member, and a structure of the first supporting structure, which supports the corkscrew, is accordingly structured so as to be able to support it.

A method for changing a bottle stopper relating to a fourteenth invention relates to a method for changing a bottle stopper of a sealed bottle with fluid contained therein with a substitute stopper. The method for changing the bottle stopper comprises: a step of detaching a bottle stopper in an airtight container filled with deterioration preventive gas; and a step of mounting a substitute stopper contained in the airtight container in place of the bottle stopper. As a result, the bottle stopper is changeable with the substitute stopper. Here, the airtight container corresponds to, for example, the airtight container of the device for changing a bottle stopper relating to the aforementioned first invention, second invention, and twelfth invention. However, it is not limited to the above, and a method for changing the bottle stopper with the substitute stopper without deterioration in a quality of fluid in the airtight container is largely included. For example, such a case that a change of the stopper is conducted in a state that the entire device is in a sealed body of deterioration preventive gas is also included.

A method for changing a bottle stopper relating to a fifteenth invention makes clear that the fourteenth invention further comprises a step of pouring deterioration preventive gas after ventilating internal air inside the airtight container. In general, there is already air in the airtight container. However, if the bottle stopper is changed leaving air as it is, not only air enters the bottle but also air becomes a cause of preventing deterioration preventive gas from entering, so that the step of ventilating air is adopted. It is needless to say that such a case that an airtight chamber with little air therein in an initial state is adopted, for example, the case for changing the stopper while containing the device for changing the stopper in an atmosphere of deterioration preventive gas does not require such a step.

A sixteenth invention is characterized in that, in the method for changing the stopper, supply of deterioration preventive gas is continued during the step of detaching the bottle stopper and the step of mounting the substitute stopper. The reason for supply thereof is that pressure reduction or the like due to gas leak or a change of volume is expecting while an airtight state is maintained during these steps, and therefore continuous gas supply definitely prevents entering air.

BRIEF DESCRIPTION OF DRAWINGS

FIGS. 16(*a*)–(*c*) are views showing the substitute stopper used in association with the present invention, wherein FIG. 16(*a*) is a cross sectional view showing a state that the substitute stopper is inserted in an opening of the bottle, FIG. 16(*b*) is a cross sectional view taken along a J—J line of FIG. 16(*a*), and FIG. 16(*c*) is a cross sectional view showing a modification of the substitute stopper of FIG. 16(*a*)

BEST MODE FOR CARRYING OUT THE INVENTION

Schematic Structure of Stopper Change Device

Figure 1:
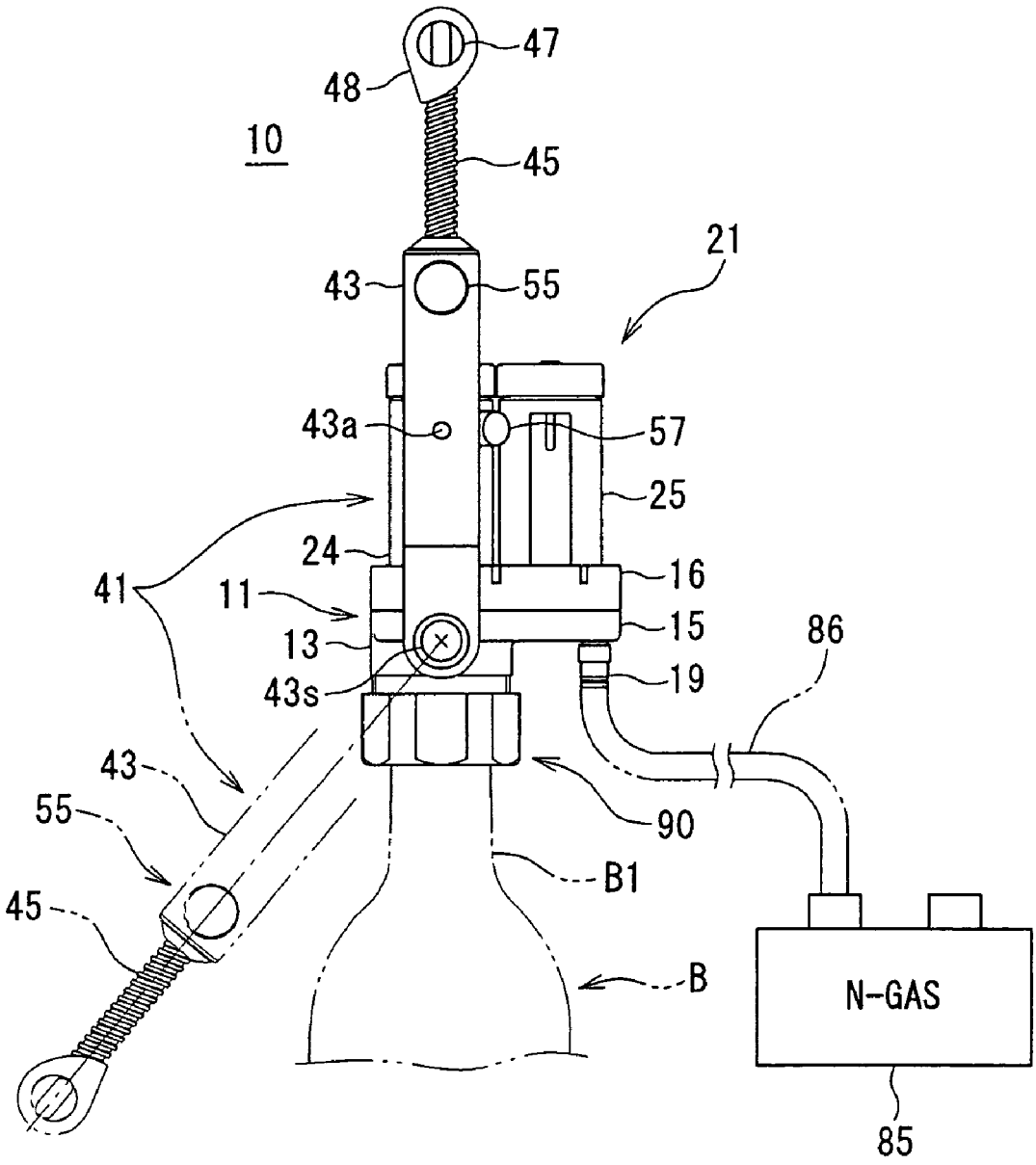
FIG. 1 is a front view showing a device for changing a stopper or a stopper change device of the present invention.
Figure 2:
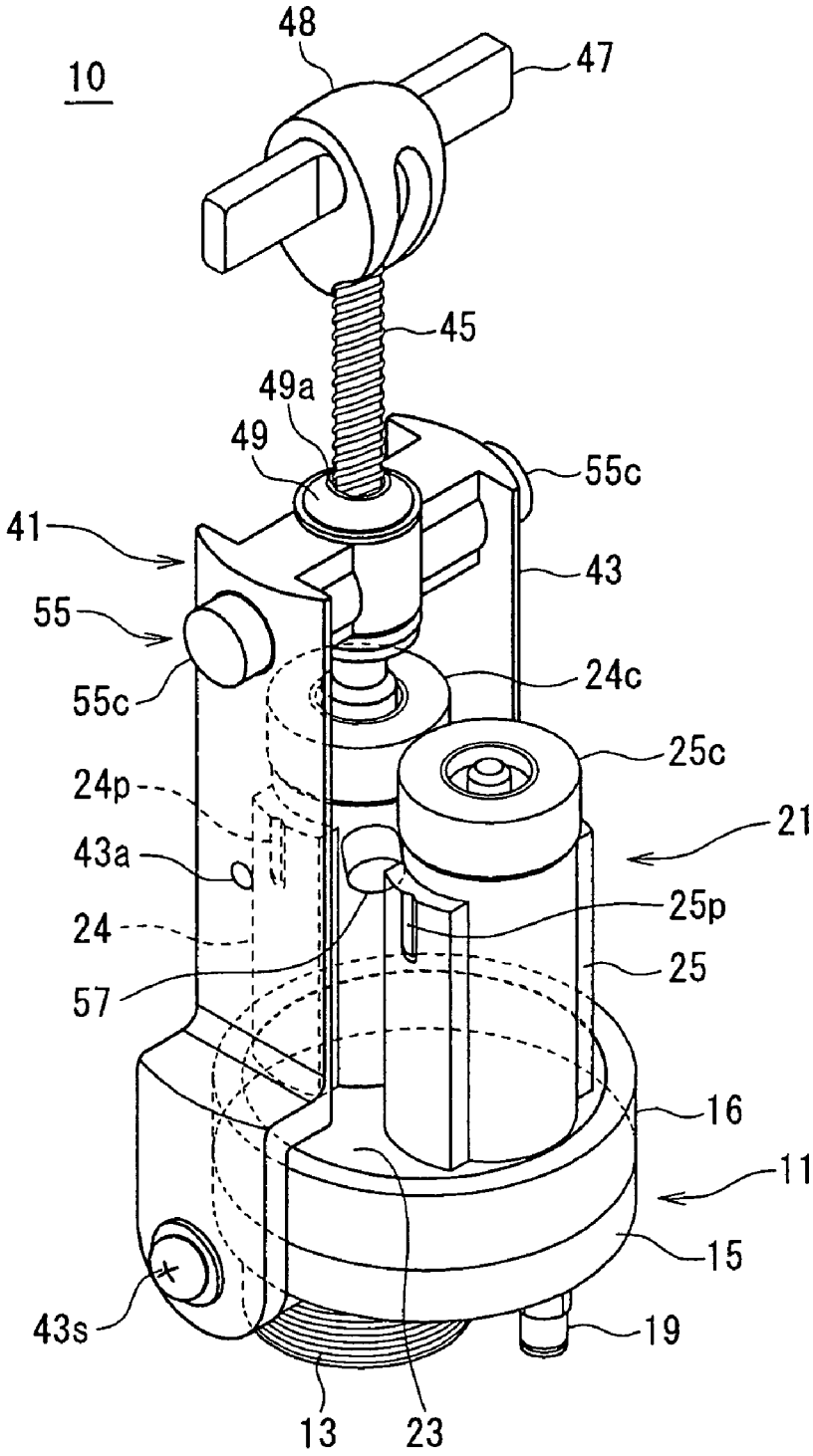
FIG. 2 is a perspective view showing the stopper change device of the present invention.
Figure 3:
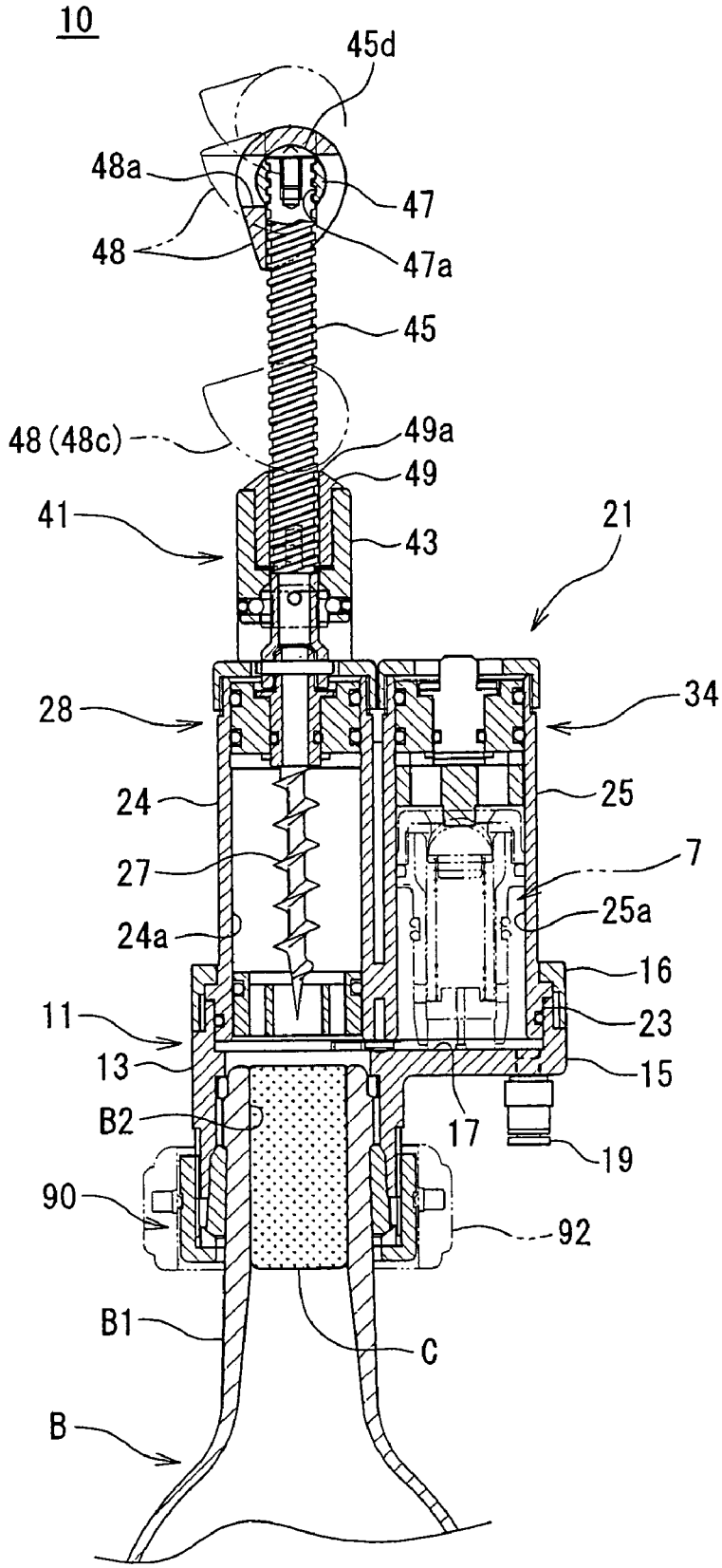
FIG. 3 is a cross sectional view showing the stopper change device of the present invention, and showing a state that the stopper change device is mounted on a head of a bottle.
Figure 4:
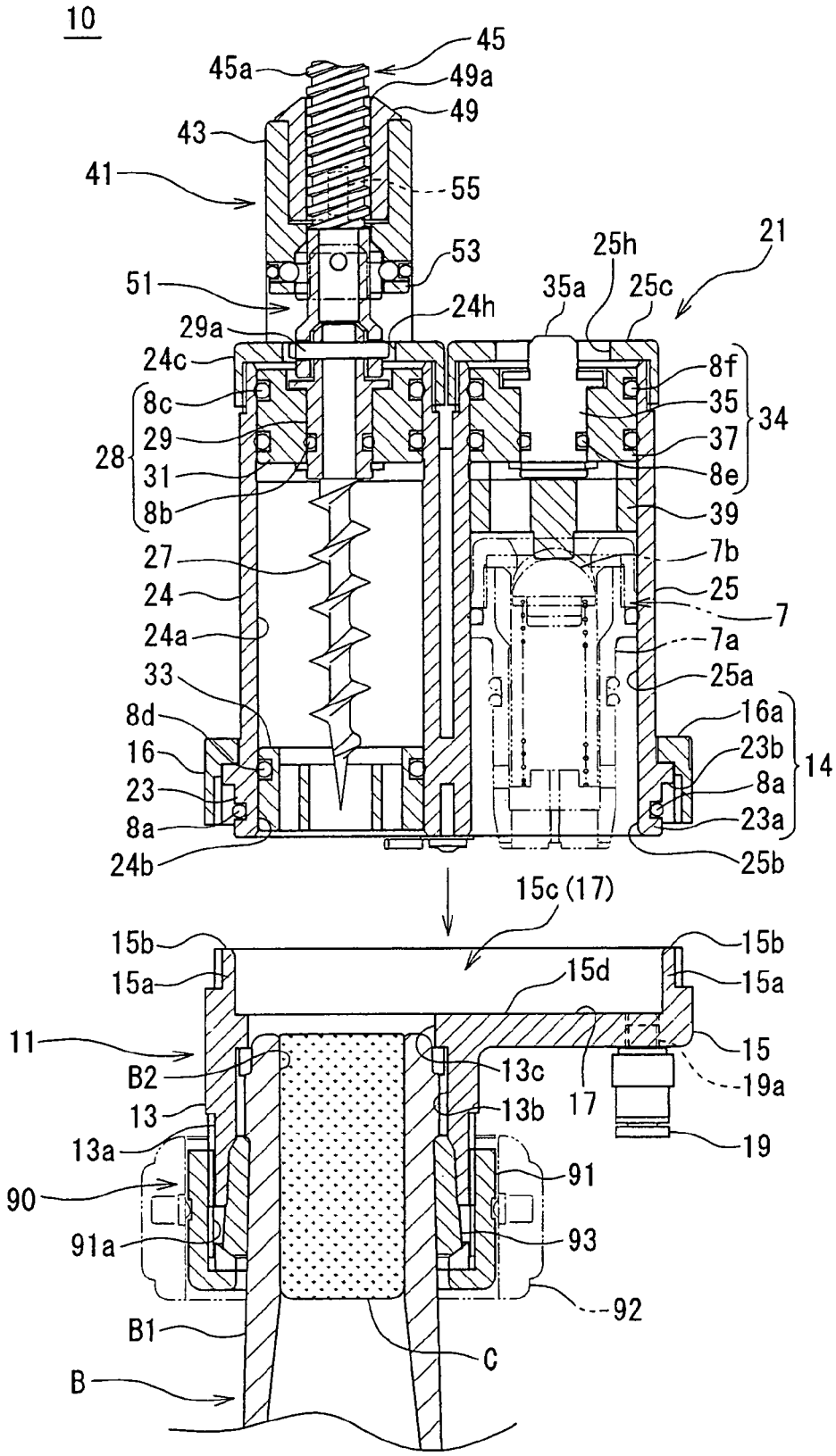
FIG. 4 is an enlarged sectional view showing a principal portion of the stopper change device of the present invention, and showing a state that a holder body mounted on the bottle and a chamber body are separated from each other.

As shown in FIG. 1 and FIG. 2, a stopper change device 10 includes a holder body 11, a chamber body 21, and an operation body 41 as principal components. As shown in FIGS. 2 to 4, the holder body 11 includes a mounting mouth 13 whose lower portion is able to mount on a head B1 of a bottle B via a coupling assist 90, and a gyration-holding portion 15 as a holding portion for laying a moving table on an upper portion of the mounting mouth 13. The chamber body 21 is provided on the holder body 11, and in addition, the operation body 41 as a means for operating the stopper change device is provided thereon. The chamber body 21 includes a first airtight tower 24 and a second airtight tower 25 standing side by side to be described later. The operation body 41 is a means for conducting a work of changing a bottle stopper, and includes a lead screw 45, a handle 47, and other means.

Kinds or characteristics about kinds of fluid in the bottle B are not questioned, however, wine is specified as typical beverage and gas (hereinafter, referred to as "N gas") having nitrogen as a main ingredient is adopted as deterioration preventive gas. The reason for adopting N gas is that it is suitable for gas for preventing deterioration in a quality of wine by blocking a contact of wine with air after opening the bottle or when extracting wine because this gas is insoluble and inert to wine. As shown in FIG. 1, supply of deterioration preventive gas to the stopper change device 10 is conducted by connecting a gas supply port 19 with a gas supply unit 85 such as a gas bomb filled with N gas through a gas supply hose 86.

(Structure of Stopper Change Device)

As shown in FIGS. 1 to 5, the stopper change device 10 is schematically structured with the holder body 11, a gyration moving table 23, a moving table supporting structure 14 (refer to FIG. 4), the chamber body 21, an air vent valve 57, a first supporting structure 28, a second supporting structure 34, and the operation body 41, and is a device for changing an existing bottle stopper C such as, for example, a cork stopper with a substitute stopper 7.

(Structure of Holder Body)

The holder body 11 is generally structured with the tubular mounting mouth 13, and a gyration holding portion (a holding portion) 15 provided on an upper portion of the mounting mouth 13. As shown in FIG. 4, a diameter of a fitting hole 13*b* inside the mounting mouth 13 is formed slightly larger than a diameter (an outside diameter) of the head B1 of the bottle, and a male screw portion 13*a* is provided on at least a lower portion of an outer peripheral portion of the mounting mouth 13. The male screw portion 13*a* engages with a female screw portion 90*a* of the coupling assist 90 to be described later, so that the coupling assist 90 is fitted on the head B1 of the bottle. The gyration holding portion 15 is formed as a thick disk shape, and has such a structure that a ring-shaped edge portion 15*a* in a ring shape with an upstanding surrounding and a circular recessed portion 15*c* enclosed by the ring-shaped edge portion 15*a* are provided on an upper face thereof (refer to FIG. 4). As described later, the recessed portion 15*c* serves also as a part of a gas passage 17. A through hole 13*c* for communicating the fitting hole 13*b* with the recessed portion 15*c* is formed on a bottom portion 15*d* between the fitting hole 13*b* of the mounting mouth 13 and the recessed portion 15*c* of the gyration holding portion 15. The through hole 13*c* is formed with such a size that the bottle stopper C and the substitute stopper 7 are passable.

(Structure of Gyration Moving Table)

The gyration-moving table (a moving table) 23 is disposed above the ring-shaped edge portion 15*a*. The gyration-moving table 23 is made of a thick-plate disk and is structured to be able to turn or rotate relative to the holder body 11 via the moving table supporting structure 14. The moving table supporting structure 14 in the embodiment is structured with the ring-shaped edge portion 15*a* of the gyration holding portion 15, an outer peripheral portion lower surface 23*b* of the gyration moving table 23 capable of abutting on an upper end face 15*b* of the ring-shaped edge portion 15*a*, a ring-shaped flange portion 23*a* extending downward from a position closer to a center than the outer peripheral portion lower surface 23*b* capable of fitting in the recessed portion 15*c*, a fixing ring 16 for pushing down from upward so as not to separate the gyration moving table 23 from the gyration holding portion 15, and an O-ring shaped packing 8*a* for holding airtight between an inner peripheral face of the ring-shaped edge portion 15*a* and an outer peripheral face of the flange portion 23*a*. The fixing ring 16 includes a ring-shaped projecting portion 16*a* projecting from a top end thereof to a center, and the ring-shaped projecting portion 16*a* pushes an upper face of the outer peripheral portion of the gyration moving table 23 so as not to separate the gyration moving table 23. Fixing of the fixing ring 16 can be done by screwing together between a screw structure of an inner face of the fixing ring 16 and a screw structure of an outer face of the ring-shaped edge portion 15*a*. On the contrary, the holder body 11 and the gyration moving table 23 can be separated by unscrewing and taking out the fixing ring 16.

A turning of the gyration moving table 23 relative to the holder body 11 is stabilized and secured by abutment of the outer peripheral portion lower surface 23*b* of the gyration moving table 23 on the upper end face 15*b* of the ring-shaped edge portion 15*a*, and by prevention of separation of the gyration moving table 23 from the gyration holding portion 15 by means of the fixing ring 16. In addition, the packing 8*a* disposed between the inner peripheral face of the ring-shaped edge portion 15*a* and the outer peripheral face of the flange portion 23*a* holds airtight of the gas passage 17 during turning of the gyration moving table 23 relative to the holder 11 while following the turn. Formation of the gas passage 17 in the recessed portion 15*c* is made possible by mean of airtight closure of the recessed portion 15*c* of the packing 8*a*.

The gas supply port 19 is attached to a lower surface of the bottom portion 15*d* of the gyration holding portion 15, and the gas supply port 19 communicates with the gas passage 17 through a gas introducing hole 19*a* passing through the bottom portion 15*d*. The gas supply port 19 is so structured that deterioration preventive gas can be introduced to the gas passage 17 by communicating with a supply plug (not shown) or the like for supplying deterioration preventive gas.

(Structure of Chamber Body)

The chamber body 21 is integrally provided on an upper portion of the gyration-moving table 23. The chamber body 21 includes a first tubular airtight tower 24 in which a screw 27 as a bottle opening member is contained, and a second similarly tubular airtight tower 25 in which a substitute stopper 7 for change can be contained in a standing position, and both towers stand up side by side on the gyration moving table 23. The first airtight tower 24 includes a first airtight chamber 24*a* in an internal portion thereof, and the second airtight tower 25 includes a second airtight chamber 25*a* in an internal portion thereof, respectively. An outside diameter of the first airtight tower 24 may be set as, for example, approximately 30 mm, which is a sum of wall thickness of the first airtight tower 24 itself and an outside diameter of a bottle stopper because the outside diameter of the bottle stopper of a wine bottle, that is, a cork stopper, is generally approximately 25 mm. In addition, a height of the first airtight tower 24 may be set as, for example, approximately 85 mm from a bottom end of the flange portion 23*a*, considering a length of a general cork stopper is approximately 60 mm. In addition, an outside diameter of the second airtight tower 25 may be set as approximately 30 mm which is the same outside diameter as that of the first airtight tower 24 because the substitute stopper having almost the same outside diameter as the diameter of the cork stopper is contained in the second airtight tower 25 in the standing position, and similarly, a height thereof set to be the same as the height of the first airtight tower 24. It is needless to say that these outside diameters or heights can be appropriately set based on a shape, a conformation, or the like of the bottle stopper or the substitute stopper.

Regarding portions made to be tubular shapes, that is, body portions of the first airtight tower 24 and the second airtight tower 25, at least these portions may be made of a transparent synthetic resin material or the like. Inner conditions can be seen through the transparent portions, and accordingly, an operation or maintenance can be easily and surely conducted, which is convenient. The gyration moving table 23 including the flange portion 23*a* or the like, the first airtight tower 24 and the second airtight tower 25 can be respectively made of different members and integrated, but, here, they are integrated by integral molding so that manufacturing costs can be reduced by reducing an assembly process or the like. As shown in FIG. 4, a first screw cap 24*c* capable of screwing on a screw structure formed on an outer peripheral face of the first airtight tower is attached on an upper portion of the first airtight tower 24, and a second screw cap 25*c* capable of screwing on a screw structure formed on an outer peripheral face of the second airtight tower 25 is attached on an upper portion of the second airtight tower 25, respectively. A circular first cap hole 24*h* is formed in a center of a top plate of the first screw cap 24*c*, and a circular second cap hole 25*h* is formed in a center of a top plate of the second screw cap 25*c*, respectively.

Since the first airtight tower 24 and the second airtight tower 25 are respectively formed as tubular shapes and in the embodiment as cylindrical shapes, the first airtight chamber 24*a* and the second airtight chamber 25*a* respectively provided therein are in perpendicular cylindrical shapes. In the gyration moving table 23, a first communicating hole 24*b* and a second communicating hole 25*b* respectively passing through in a thickness direction are formed on positions respectively communicable with the first airtight chamber 24*a* and the second airtight chamber 25*a*. Therefore, the first airtight chamber 24*a* and the second airtight chamber 25*a* communicate with the gas passage 17 via the first communicating hole 24*b* and the second communicating hole 25*b*. The aforementioned screw 27 is positioned in the first airtight chamber 24*a*, and similarly, the substitute stopper 7 is positioned in the second airtight chamber 25*a*, respectively. The first communicating hole 24*b* and the second communicating hole 25*b* are almost the same size as that of the through hole 13*c*, that is, a size through which the bottle stopper C or the substitute stopper 7 is passable.

As described above, since the chamber body 21, that is, the first airtight tower 24 and the second airtight tower 25, is integrated with the gyration moving table 23, relative positions of the chamber body 21 to the holder body 11 can be mutually changed by the turn of the gyration moving table 23. In the present specification, a position where the first communicating hole 24*b* and the through hole 13*c* are lined up is called a first position, and a position where the second communicating hole 25*b* and the through hole 13*c* are lined up is called a second position, respectively. Accordingly, when the gyration moving table 23 is positioned on the first position, the cork stopper can be pulled in the first airtight chamber 24*a* through the through hole 13*c* and the first communicating hole 24*b*. When the gyration moving table 23 is positioned on the second position, the substitute stopper 7 contained in the second airtight chamber 25*a* can be pushed and inserted in a head opening B2 through the second communicating hole 25*b* and the through hole 13*c*. Pulling the cork stopper or inserting the substitute stopper is caused by mainly operations of the first supporting structure 28, the second supporting structure 34, and the operation body 41 to be described later.

(Structure of First Supporting Structure)

The first supporting structure 28 is structured with a first piston 31 capable of moving upward and downward inside the first airtight chamber 24*a*, a supporting member 29 capable of rotating relative to the first piston 31, an O-ring shaped packing 8*b* for holding airtight between an inner peripheral face of the first piston 31 and an outer peripheral face of the supporting member 29, and a similar O-ring shaped packing 8*c* disposed between an outer peripheral face of the first piston 31 and an inner peripheral face of the first airtight tower 24. The supporting member 29 is integrated with a base portion of the screw 27 as a bottle-opening member, and the screw 27 is also rotated according to a rotation of the supporting member 29. The entire first supporting structure 28 is moved upward and downward according to the operation of the operation body 41 to be described later, and the supporting member 29 is rotated according to the up and down movement. Therefore, the screw 27 is moved upward and downward while rotating in the first airtight chamber 24*a* according to the operation of the operation body 41. On an inside lower portion of the first airtight chamber 24*a*, a screw guide 33 is fitted to be able to move upward and downward through an O-ring shaped packing 8*d*. The screw guide 33 is a guide member for aligning a tip portion of the screw 27 with a center of the cork stopper C, and is so structured to be pushed up by moving upward of the cork stopper C, and pushed down by the first piston 31. The screw guide 33 may be omitted when the alignment with a center is not necessary. It should be noted that the first piston 31 is made of synthetic resin because it is not only light weighted but also easily processed, however, the first piston 31 can be made of a metal or other raw materials. The same thing can be said of a second piston 37 to be described later.

(Structure of Second Supporting Structure)

The second supporting structure 34 is provided on an upper portion in the second airtight chamber 25*a*. The second supporting structure 34 is structured with the second piston 37 capable of moving upward and downward inside the second airtight chamber 25*a*, a press-down member 35 capable of rotating relative to the second piston 37, an O-ring shaped packing 8*e* for holding airtight between an inner peripheral face of the second piston 37 and an outer peripheral face of the press-down member 35, and a similar O-ring shaped packing 8*f* disposed between an outer peripheral face of the second piston 37 and an inner peripheral face of the second airtight tower 25. The packing 8*e* serves as a means for holding airtight between the second piston 37 and the press-down member 35, and the packing 8*f* serves as a means for holding airtight between the second piston 37 and the second airtight tower 25, respectively. The press-down member 35 is a member for abutting on an upper end of the substitute stopper 7 contained in the second airtight tower 25, for integrally moving downward with the second piston 37, and for pushing down the substitute stopper 7 by the down movement. The press-down member 35 does not have to be rotated in order to push down the substitute stopper 7, however, it is able to rotate in order to commonly share the operation body 41 to be described later with the aforementioned supporting member 29. The press-down member 35 can be used without rotating by, for example, providing a means for canceling a rotation of a lead screw (described later) constituting the operation body 41, or by providing an operation body that is individually operable for the press-down member 35 without commonly sharing.

A slider 39 is fitted below the second piston 37. The slider 39 is so structured that its outer peripheral face is able to slide on an inner peripheral face of the second airtight chamber 25*a*, that the slider 39 is pushed down and moved downward by the second piston 37, and that the slider 39 is pushed up and moved upward by the substitute stopper 7 when the substitute stopper 7 is inserted. The slider 39 serves as a means for preventing shaking relative to the second airtight chamber 25*a* as a main purpose when the second piston 37 is moved downward, however, the slider 39 may be omitted if not necessary. A space in the second airtight tower 25, that is, the space under the slider 39 in the second airtight chamber 25*a*, is a space with a size in which the substitute stopper 7 can be contained. The substitute stopper 7 contained in the second airtight tower 25*a* can project from a lower portion thereof in a direction of a bottle disposed thereunder by moving downward of the press-down member 35 or the like. Incidentally, a circularly projected engaging portion (a connector receiving portion) 35*a* is formed on a top end portion of the press-down member 35.

To the respective internal portions of the first airtight chamber 24*a*, the second airtight chamber 25*a*, and the mounting mouth 13, N gas introduced from the gas supply port 19 provided on a lower portion of the holder body 11 can be supplied through the gas passage 17 from a gas introducing path 19*a*. Furthermore, N gas can also be supplied into the bottle B through the through hole 13*c* when the cork stopper C is pulled out of the bottle B.

(Structure of Operation Body)

Figure 5:
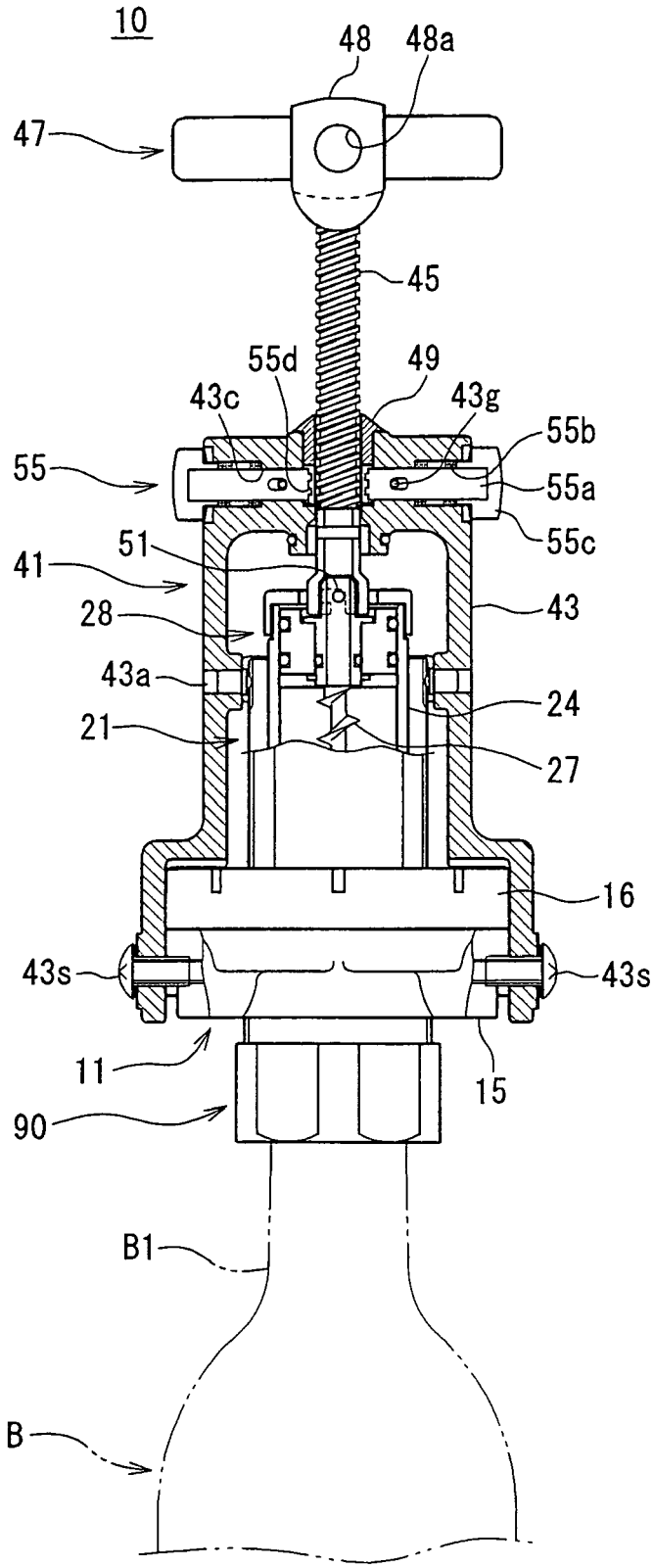
FIG. 5 is a partial sectional view showing the stopper change device of the present invention, and showing a state that the stopper change device is mounted on the head of the bottle.

The operation body 41 is a component for pulling the cork stopper by means of the screw 27 in the first airtight tower 24, for pushing the substitute stopper contained in the second airtight tower 25, or the like. As shown in FIGS. 2 to 6, the operation body 41 includes a bifurcated swing lever 43 supported to be able to swing with the holder body 11, a lead screw 45 slidably inserted relative to the swing lever 43, and a handle 47. As shown in FIG. 5, the swing lever 43 is formed as a downward U-shape with a step, and its bottom end portion is supported to be able to swing with the holder body 11 by a supporting shaft 43*s*. A shaft-receiving member 49 is provided on a top portion of the swing lever 43. Numerical reference 43*a* shown in FIG. 7 denotes positioning elements provided inside the swing lever 43, and the positioning elements 43*a* can engage with a first engaging piece 24*p* provided on an outer periphery of the first airtight tower 24 or a second engaging piece 25*p* provided on an outer periphery of the second airtight tower 25 (refer to FIG. 2). This engagement positions the swing lever 43 relative to the first airtight tower 24 or the second airtight tower 25.

Figure 6:
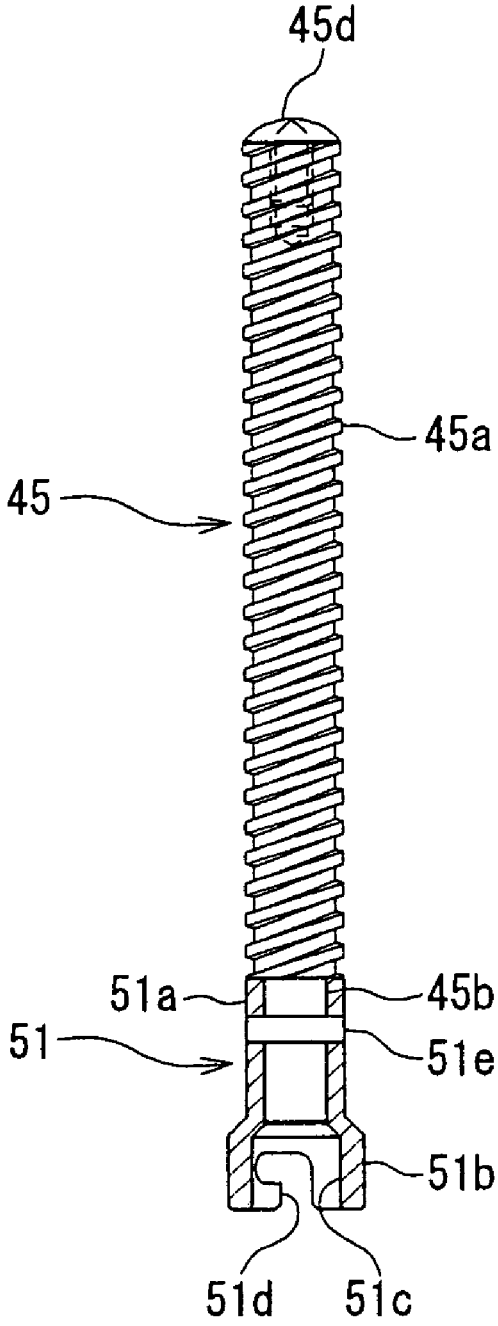
FIG. 6 is a front view showing a lead screw and a connector used for the stopper change device of the present invention, and showing a portion in a cross sectional view.

As shown in FIG. 6, the lead screw 45 is structured with a male screw portion 45*a* having a square thread formed on an outer peripheral portion of a steel bar member of a predetermined length, and a straight portion 45*b* whose predetermined length of a range from a bottom end is formed as a solid pillar with a circle circumference. Support of the lead screw 45 is conducted by the shaft-receiving member 49 provided on the top portion of the swing lever 43. The lead screw 45 in a normal state freely slides relative to the shaft-receiving member 49 and is relatively movable in a direction of a length of the swing lever 43 (a vertical direction of FIG. 5). On the other hand, a clutch mechanism 55 to be described later is also provided on the top portion of the swing lever 43, and is so structured that a motion of the lead screw 45 is restricted when the clutch mechanism 55 is in operation. The male screw portion 45*a* and the straight portion 45*b* may be integrated. An engaging member (a connector receiving portion) 53 of the lead screw 45 is provided below the shaft-receiving member 49.

As shown in FIG. 3 and FIG. 5, a hole portion 48*a* for transversely passing through the lead screw 45 is provided in the handle 47, and a female screw portion 47*a* constituting a screw pair with the male screw portion of the lead screw 45 is formed on an inner peripheral face which encloses the hole portion 48*a*. With this structure, a relative motion between the handle 47 and the lead screw 45 is made possible by rotating the handle 47. Furthermore, the handle 47 is so structured, not to be separated by a stopper screw 45*d* screwed on the top portion of the lead screw 45. In place of the stopper screw 45*d*, the top portion of the lead screw 45 can be formed as the same shape of a top of a screw. A switching member 48 whose transverse section is formed as substantially a heart shape is inserted to be able to swing within a range of 90° at the center of the handle 47. The switching member 48 is so structured that a projecting portion of the member can be turned downward as shown in a solid line in FIG. 3, or that the projecting portion of the member can be turned horizontally as shown in a two-dot chain line when the handle 47 is positioned on the top end portion of the lead screw 45.

When the switching member 48 is turned downward, the top end portion of the lead screw 45 abuts on the inner peripheral face of the switching member 48, which obstructs down movement of the handle 47. In other words, when the handle 47 is rotated, the top end portion of the lead screw 45 shows a tendency of projecting from the hole portion 48*a* thereof. However, the projection of the top end portion of the lead screw is obstructed by the inner peripheral face of the switching member 48, and therefore, the handle 47 cannot be rotated any further. In a state shown in FIG. 5, since the hole portion 48*a* faces the front direction in the drawing, the projection of the top end portion of the lead screw 45 is obstructed. On the other hand, as similarly shown in the two-dot chain line in FIG. 3, when the projecting portion of the switching member 48 is turned horizontally, the hole portion 48*a* is moved upward, which allows the projection of the top end portion of the lead screw 45. Therefore, the handle 47 becomes free from the lead screw 45, which allows a relative up and down movement between the handle 47 and the lead screw 45 by a screw motion.

Figure 8:
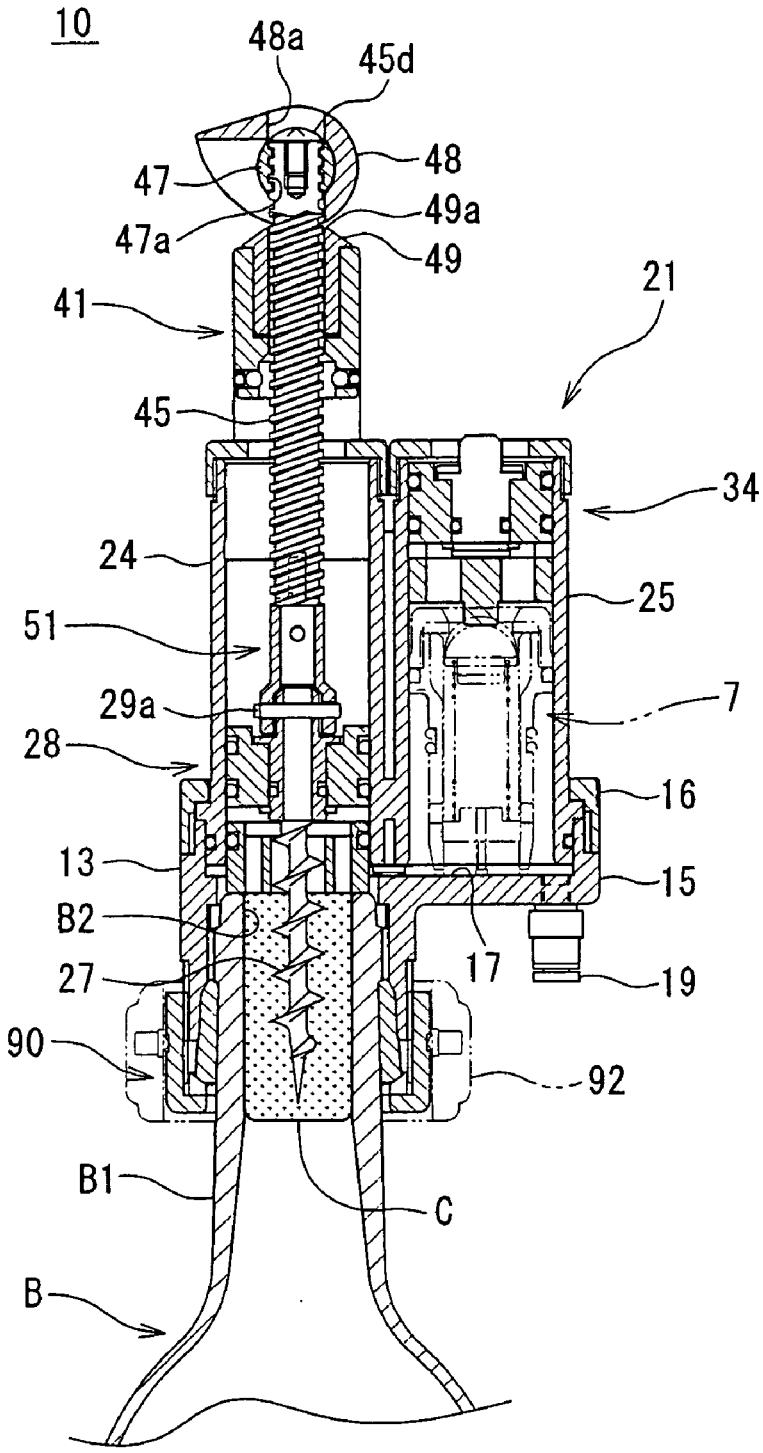
FIG. 8 is a cross sectional view showing the stopper change device of the present invention, and showing a state that a bottle opening member of the stopper change device in FIG. 3 is moved downward and that a corkscrew is impaled in a cork stopper.

When the switching member 48 is turned downward, that is, when the relative up and down movement between the handle 47 and the lead screw 45 becomes obstructed, both the handle 47 and the lead screw 45 are integrally rotated in a state that both components are fixed. When the handle 47 is rotated in such an integral state, the lead screw 45 is also rotated according to the rotation of the handle 47. The rotating lead screw 45 is moved downward relative to the shaft-receiving member 49. As shown in FIGS. 3 and 8, when the down movement is proceeded and when the switching member 48 reaches the bottom end, a cam face 48*c* of the switching member 48 abuts against an abutting face 49*a* on a top end of the shaft-receiving member 49. Besides, the switching member 48 is swung by a cam action generated by further moving downward. This swing moves the hole portion 48*a* to a position, which allows the projection of the top end portion of the lead screw 45. When the swing of the switching member 48 is completed, the shaft-receiving member 49 obstructs further down movement of the handle 47. Here, when the handle 47 is further rotated against drag of the shaft-receiving member 49, a slip is generated between the abutting switching member 48 and shaft-receiving member 49, and only the lead screw 45 is moved upward while the handle 47 remains as it is due to a screw action between the lead screw 45 integrated with the handle 47 and the shaft-receiving member 49. The upward movement of the lead screw 45 directly accompanies the upward movement of the screw 27, and the upward movement of the screw 27 is nothing but the upward movement of the cork stopper C, that is, pulling the cork stopper from the head of the bottle.

Figure 7:
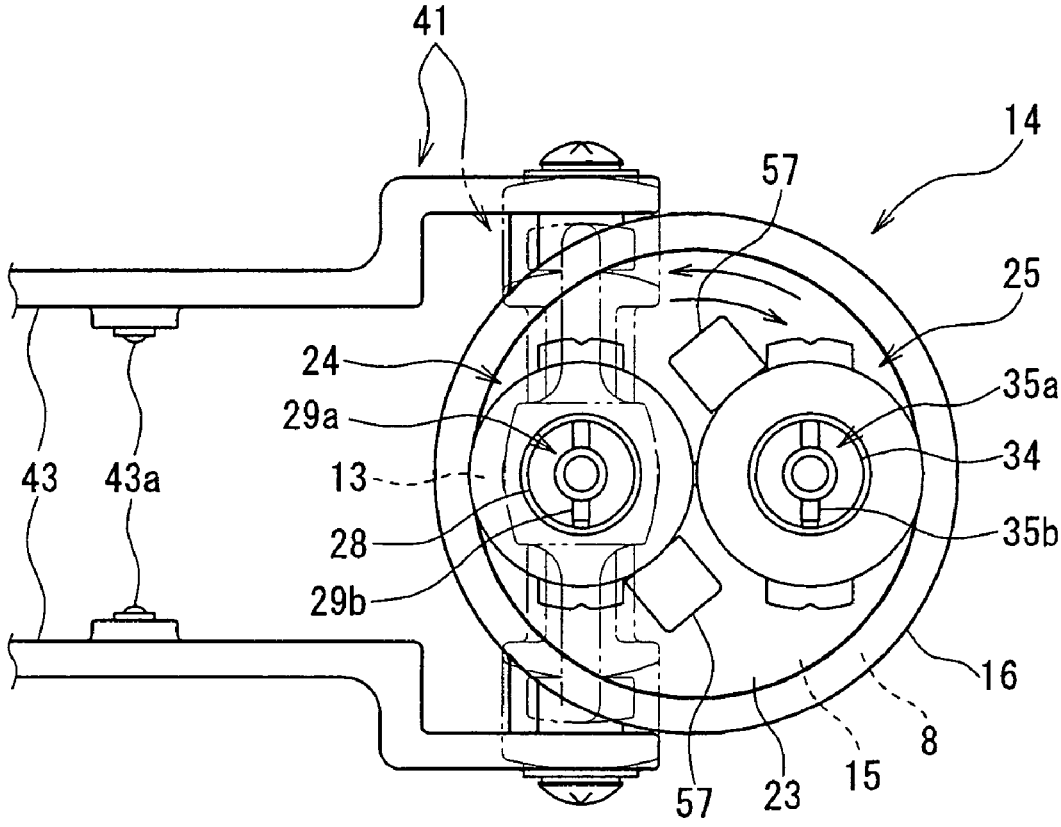
FIG. 7 is a top plan view showing a gyrating table and the chamber body used for the stopper change device of the present invention.

A connector 51 is connected to the straight portion 45*b* on a lower portion of the lead screw 45. As shown in FIG. 6, the connector 51 is composed of a tubular pressing portion 51*a* and a connector portion 51*b* having a larger diameter than the pressing portion 51*a*. As shown in FIG. 7, on the connector portion 51*b*, a recessed portion 51*c* is formed, which is able to contain an engaging member 29*a* provided on a head of the supporting member 29 included in the first supporting structure 28, or the engaging member 35*a* of the press-down member 35 included in the second supporting structure 34. On a lower end portion of the connector portion 51*b*, a pair of crank-shaped recessed portions 51*d* are provided in a symmetrical positions, which receive an engaging pin 29*b* included in the engaging member 29*a*, or an engaging pin 35*b* included in the engaging member 35*a* (refer to FIG. 7), and transmit the rotation of the lead screw 45 to the supporting member 29 or the press-down member 35 by the engagement. The connector 51 is pressed into a tip portion of the straight portion 45*b* of the lead screw 45 and is prevented from falling off by a locking pin 51*e* knocked in a right angle at a midpoint within a pressed range.

As shown in FIG. 5, in the vicinity of the upper portion of the swing lever 43, the clutch mechanism 55 as a selecting means for selecting whether or not a move screw mechanism (a screw pair) is realized is provided. The clutch mechanism 55 is a manual clutch including a pair of clutch pieces 55*a* inserted in a clutch hole 43*c* provided on both sides of the swing lever 43, compression springs 55*b* for biasing the respective clutch pieces outward, and push buttons 55*c*. On inner end portion of each clutch piece 55*a*, female screw portion 55*d* corresponding to a screw thread of the male screw portion 45*a* of the lead screw 45 is formed. By pushing these female screw portions from both sides, a screw pair is realized between the male screw portion of the lead screw 45 and the clutch piece 55*a*, and therefore, the move screw mechanism is realized only when the push buttons 55*c* are pushed. Therefore, when the lead screw 45 is rotated by engaging the clutch mechanism, the lead screw 45 can move upward and downward relative to the swing lever 43. In passing, each clutch piece 55*a* is held unable to separate from the swing lever 43 by means of a guide 43*g*. By using the stopper change device in which such the clutch mechanism is provided, as described later, pressing work of the substitute stopper can be relatively easily conducted not requiring large force. However, it should be noted that the stopper change device 10 does not always have to include this clutch mechanism. A person familiar with a pressing operation and having relatively strong muscle can easily press the substitute stopper even if the clutch mechanism is not used.

An air vent valve 57 (refer to FIGS. 1 and 2) is provided in the vicinity of respective upper portions of the first airtight tower 24 and the second airtight tower 25. It is opened when deterioration preventive gas is supplied after mounting the stopper change device 10 on the head of the bottle, and is used for exhausting air in the gas passage 17, in the respective airtight chambers 24*a* and 25*a*, and in a space directly or indirectly communicating therewith, and is used for sealing only this gas. Furthermore, when carbon dioxide gas is used as deterioration preventive gas, this gas being heavier than air, the air vent valve 57 also serves as a gas vent valve through which air is able to exhaust by appropriately opening the air vent valve 57 in order to avoid detaining air on an upper portion of the airtight chambers. The air vent valve 57 may be automatically open when reaching a predetermined pressure, or may be manually open. Furthermore, as explained above, since the air vent valve is a valve for exhausting air in the gas passage 17, in the first airtight chamber 24*a*, in the second airtight chamber 25*a*, and in the space directly or indirectly communicating therewith, a structure, a principle of operation, or the like of the air vent valve is not limited as long as such air is exhausted, and a place for mounting or the like thereof can be appropriately changed.

(First Modification of Stopper Change Device)

An explanation will be given based on FIGS. 11 to 14. A difference between a first modification and the aforementioned present embodiment is that this modification is so structured that at least a part of an airtight container is made of a flexible material, and that the substitute stopper is able to mount on the head of the bottle in place of the bottle stopper detached from an outside of the airtight container by utilizing flexibility of the flexible material while the present embodiment is so structured that the first airtight tower in which the corkscrew is contained and the second airtight tower in which the substitute stopper is contained are changed their positions by means of the turn of the gyration moving table.

In other words, a stopper change device 151 is generally structured with a flexible airtight container 153, a mounting mouth 155 communicating with an inside of the airtight container 153, a gas supply port 157 for supplying deterioration preventive gas in the airtight container 153, an air vent valve 159 for exhausting air from the airtight container 153, and an operation body 165 for operating from outside a corkscrew (a bottle opening member) 163 contained in the airtight container 153.

The airtight container 153 is made of a material having airtight and flexibility, for example, a sheet made of synthetic resin, synthetic leather, or the like being formed in a bag shape, and is structured to be mounted keeping airtight on the head of the bottle through the mounting mouth 155. The airtight container 153 is so structured that a user can change the cork stopper C with a substitute stopper 167 with his/her hands from outside utilizing the flexibility, and therefore, the airtight container 153 is formed with a size enough to conduct the change work. The mounting mouth 155 is so structured basically to have the same structure and to obtain the same effect as the mounting mouth 13 in the aforementioned present embodiment. Furthermore, the gas supply port 157 and the air vent valve 159 are also so structured respectively to have the same structure and to obtain the same effect as the gas supply port 19 and the air vent valve 57.

Figure 11:
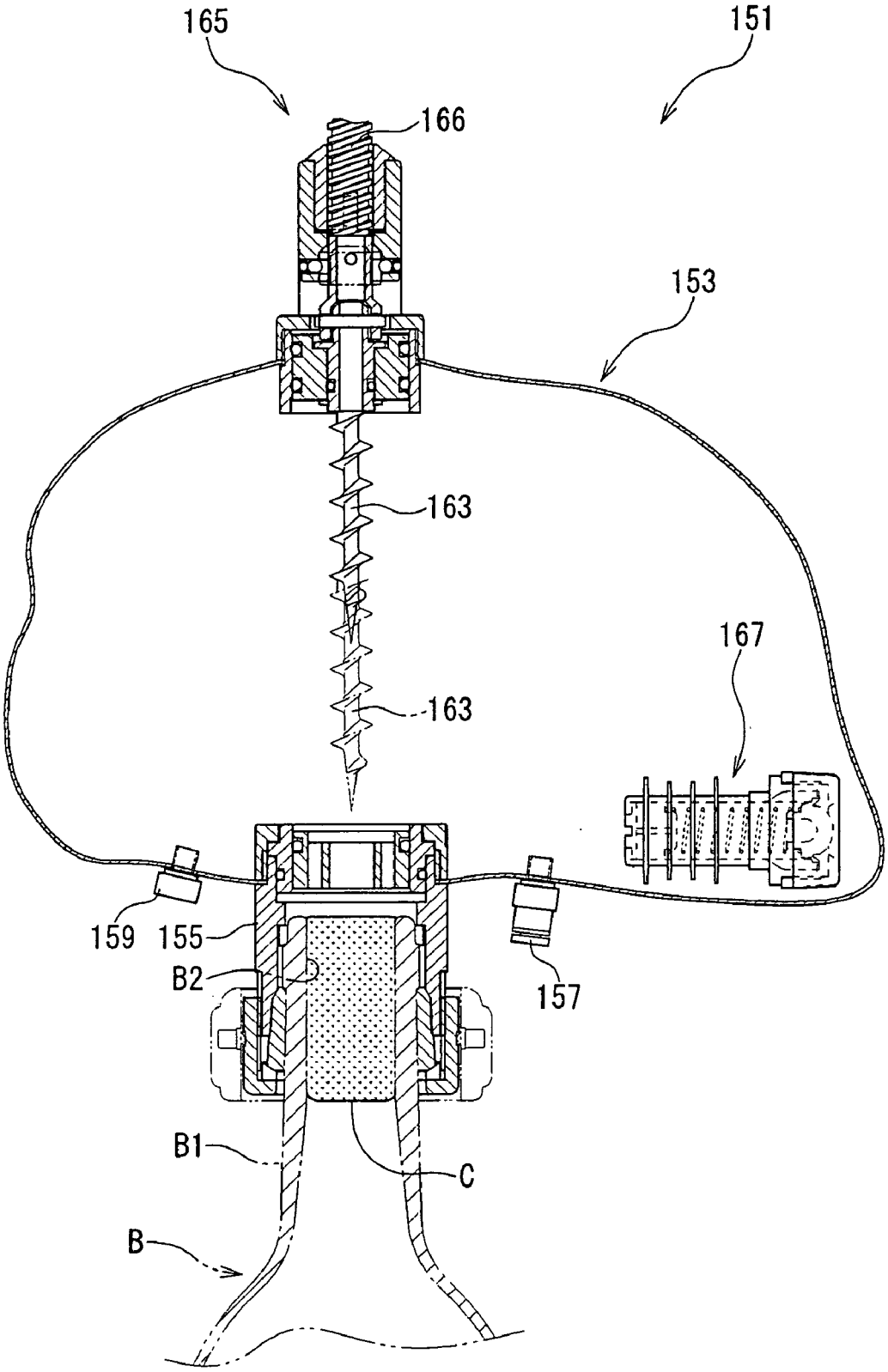
FIG. 11 is a cross sectional view showing a first modification of the stopper change device of the present invention, and showing a state that the stopper change device is mounted on the head of the bottle.
Figure 12:
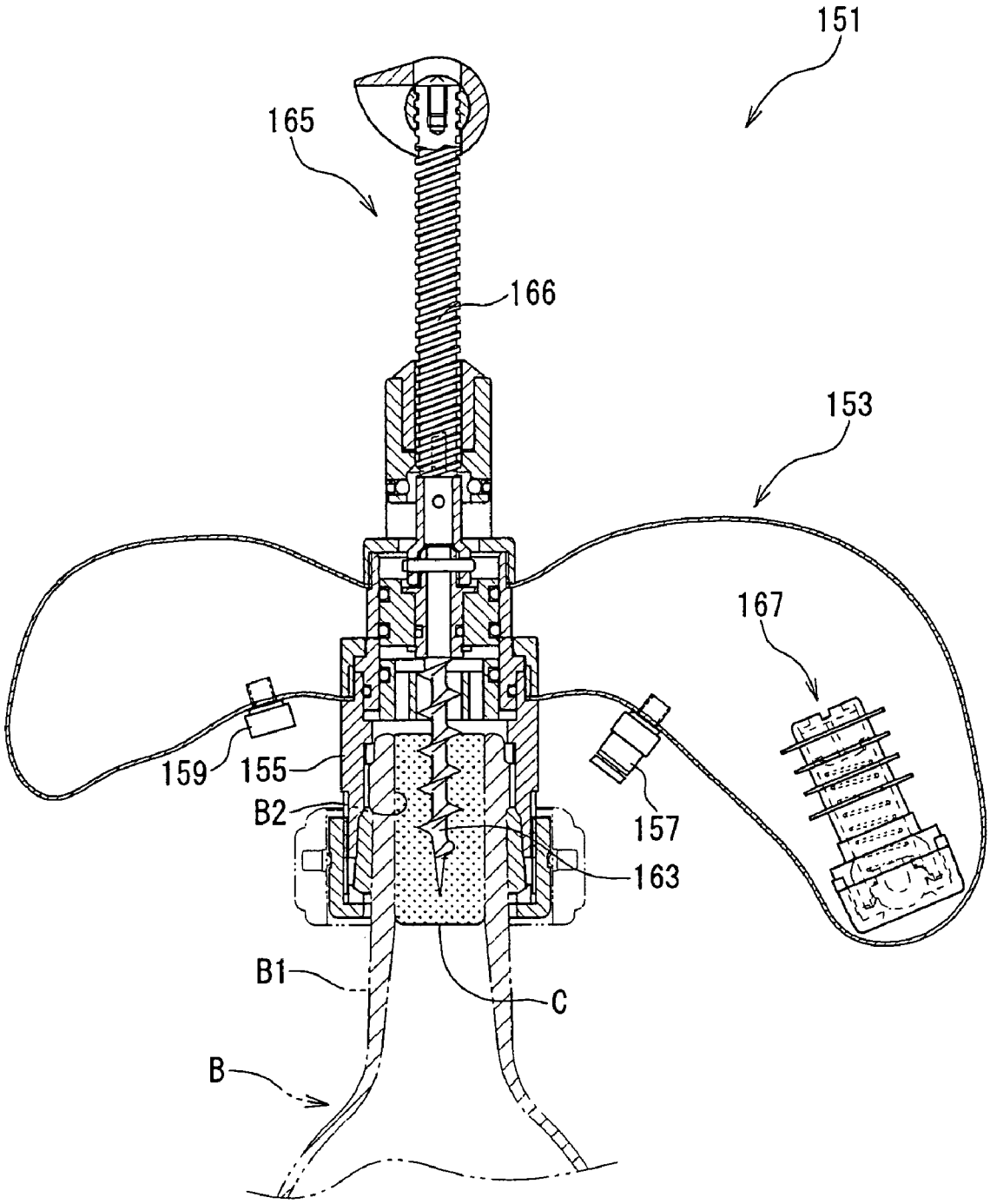
FIG. 12 is a cross sectional view showing the first modification of the stopper change device of the present invention, and showing a state that an operation body of the stopper change device in FIG. 11 is moved downward, and that a corkscrew is impaled in a cork stopper.
Figure 13:
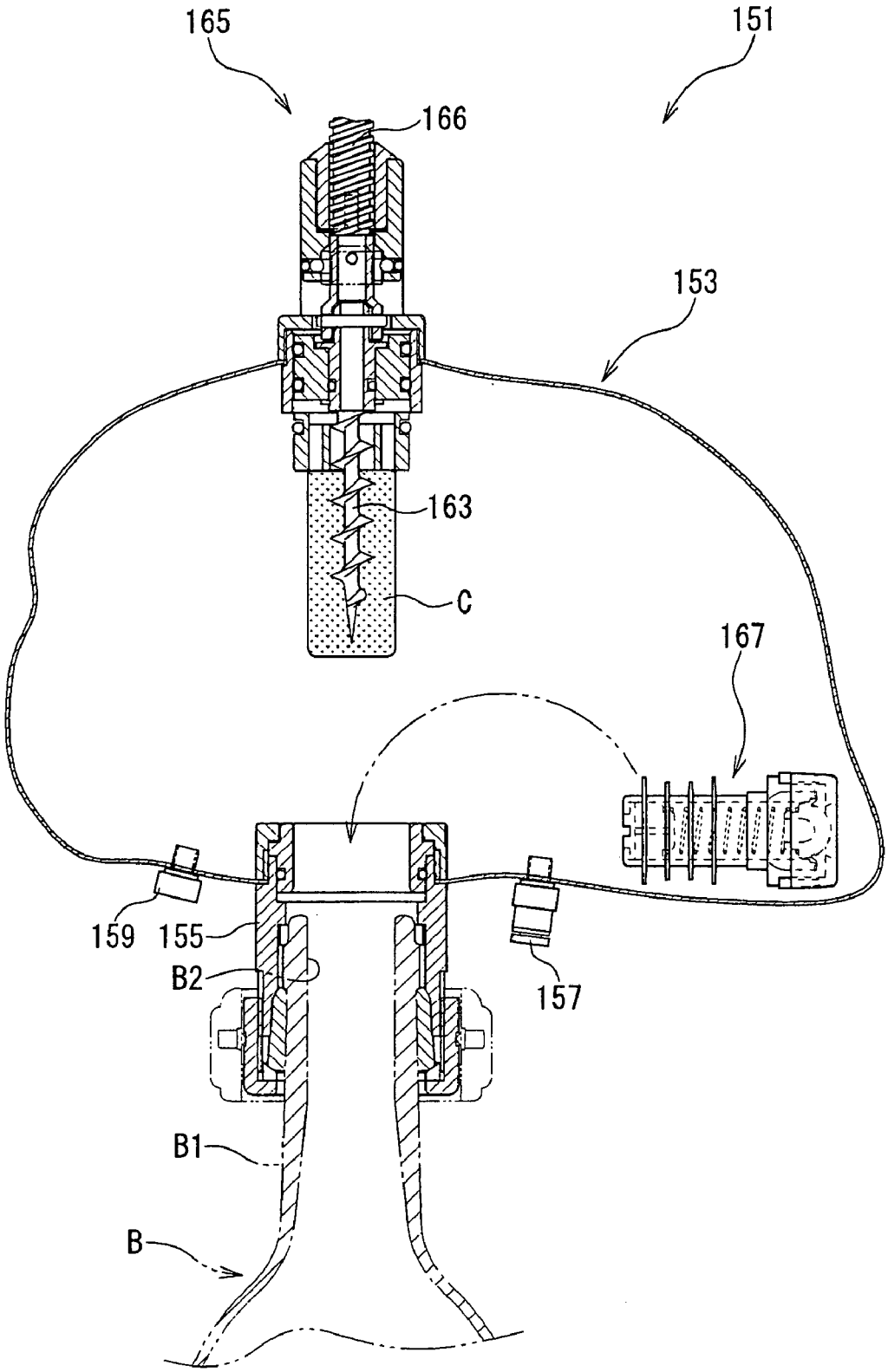
FIG. 13 is a cross sectional view showing the first modification of the stopper change device of the present invention, and showing a state that the operation body of the stopper change device in FIG. 12 is moved upward, and that the cork stopper is pulled out.

A method for using the stopper change device 151 is as follows. First, as shown in FIG. 11, while N gas is poured from the gas supply port 157, air in the airtight container 153 is exhausted from the air vent valve 159 so that the inside of the airtight container 153 is in N gas atmosphere. Next, the head of the bottle is held with one hand while the operation body 165 is moved to an upper region of the mounting mouth 155 with the other hand, and a tip of the corkscrew 163 is pushed on the cork stopper C and the corkscrew 163 is slightly rotated so that the tip portion thereof can be impaled. The operation body 165 temporarily supported by impaling the tip is supported with one hand while the lead screw 166 of the operation body 165 is rotated with the other hand so that the corkscrew 163 can be deeply impaled in the cork stopper C (refer to FIG. 12). The operation body 165 is moved downward according to the impaling, which is made possible by means of the flexibility of the airtight container 153. When the corkscrew 163 is impaled to a certain extent, the operation body 165 is moved upward and the cork stopper C is pulled out while holding the bottle B with one hand. This pulling is also made possible by means of the flexibility of the airtight container 153.

Figure 14:
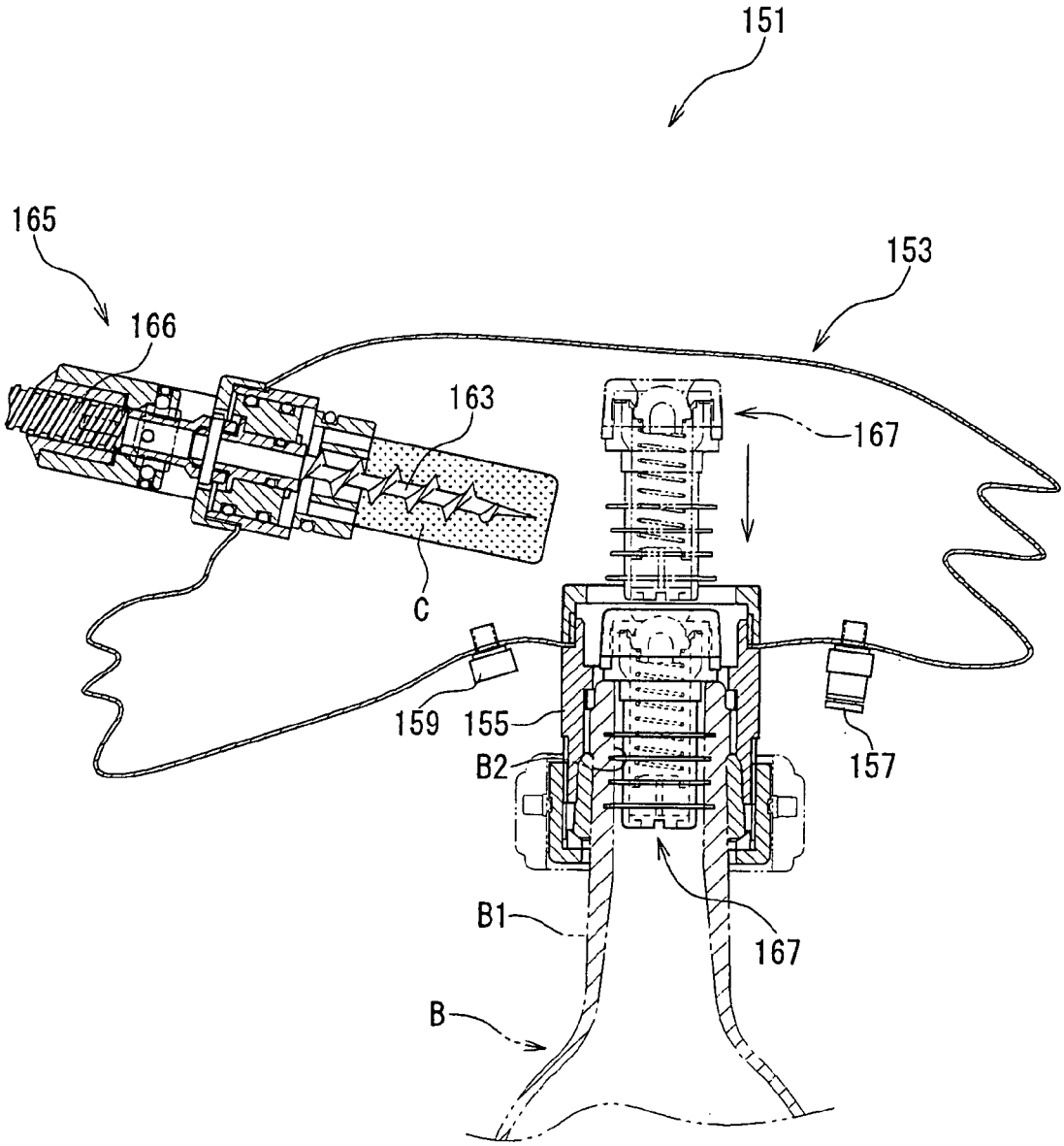
FIG. 14 is a cross sectional view showing the first modification of the stopper change device of the present invention, and showing a state that a substitute stopper is inserted into a bottle in an airtight container filled with N gas.

After the cork stopper C is completely pulled out, as shown in FIG. 14, the cork stopper C is put aside of the bottle B along with the operation body 165, and the substitute stopper 167 in place thereof is grasped from an outside of the airtight container 153, inserted in the opening B2 of the bottle B, and is pushed from upward. When the substitute stopper 167 is completely inserted, the mounting mouth 155 is taken out of the bottle head B1. This is the end of the work of changing the stopper. The stopper change device 151 is so structured that a change of the stopper is made possible by utilizing the flexibility of the airtight container 153 and that the structure for a complicated change is omitted. Therefore, the stopper change device 151 can be structured extremely simple compared with the aforementioned stopper change device 10. Furthermore, the airtight container 153 can be folded due to the flexibility thereof, therefore, the folding thereof allows for compact storage of the stopper change device 151 when it is not used or the like. Furthermore, the airtight container 153 does not allow outside air to enter into an inner space thereof, therefore, the change of the stopper can be conducted without allowing the air as a cause of oxidation (a cause of deterioration) to enter the bottle. In passing, the aforementioned airtight container 153 is preferably made of a transparent. (or translucent) material in order to see through the inside thereof. A work of changing the stopper is made possible smoothly because the work can be conducted while seeing through the inside of the airtight container 153 using such a material.

Second Modification of Present Embodiment

Figure 15:
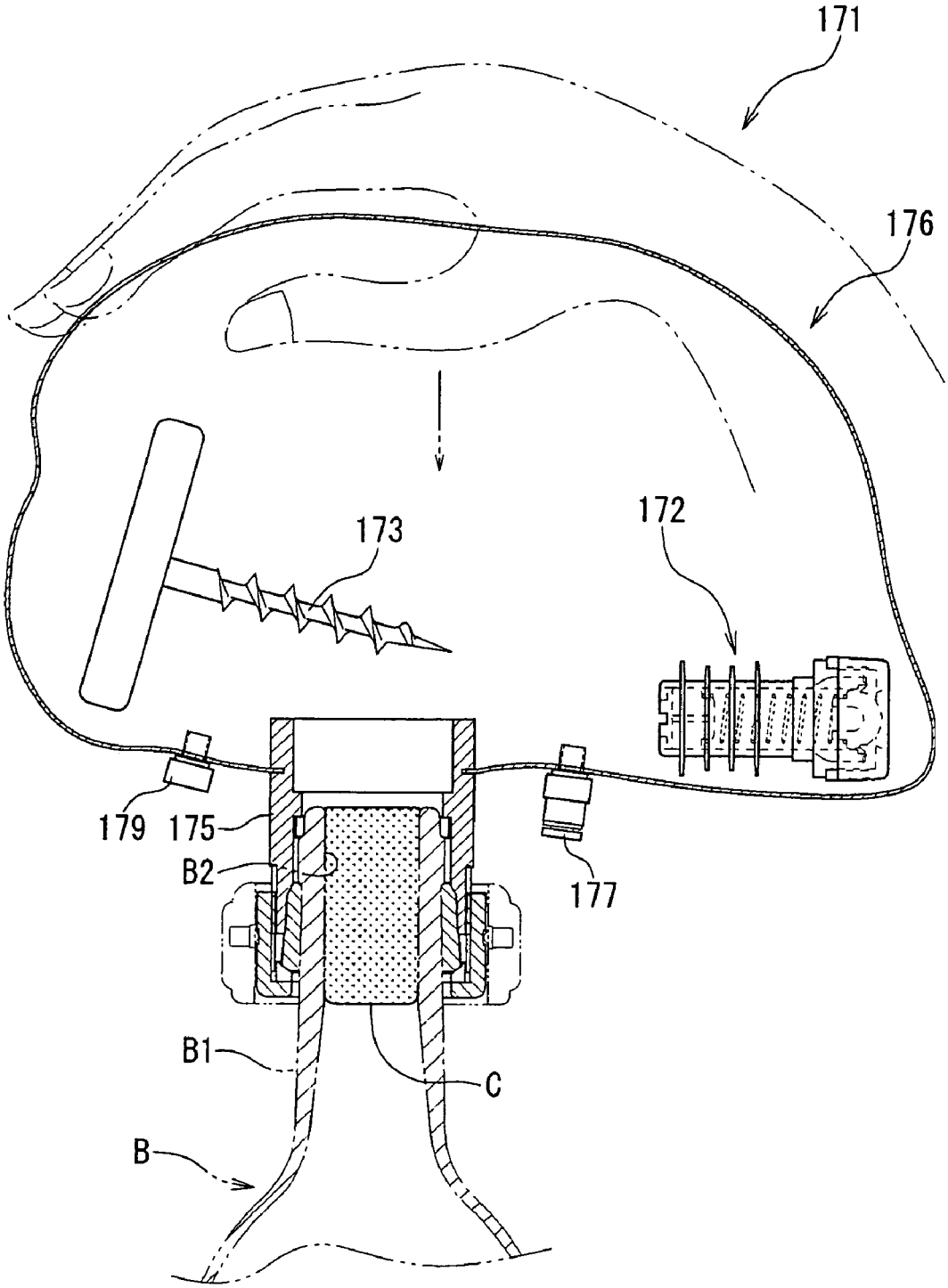
FIG. 15 is a cross sectional view showing a second modification of the stopper change device of the present invention, and showing a state that the stopper change device is mounted on the head of the bottle.

An explanation will be given based on FIG. 15. A stopper change device 171 relating to a second modification of the present embodiment contains not only a corkscrew 173 as a bottle opening member but also a substitute stopper 172 in an airtight container 176. A mounting mouth 175, a gas supply port 177, and an air vent valve 179 have the same structure as those described in the first modification. A replacement work for which the stopper change device 171 is used can be conducted in such a manner that the corkscrew 173 is operated to pull out the cork stopper C from an outside of the airtight container 176 having flexibility, and that the substitute stopper 172 is inserted in place of the cork stopper C. Similar to the aforementioned stopper change device 151, the stopper change device 171 has a simple structure, and allows for compact storage, which is user-friendly. In addition, similar to the aforementioned stopper change device 151, the airtight container 176 does not allow outside air to enter into an inner space thereof Therefore, a change of the stopper can be conducted without allowing the air as a cause of oxidation (a cause of deterioration) to enter into the bottle.

(Structural Example of Substitute Stopper)

Here, the substitute stopper 7 will be explained in detail with reference to FIGS. 16*a*–16*c*. As shown in the drawing, the substitute stopper 7 is a plug with a valve including a discharge valve 7*b* in a body 7*a*, and a structure thereof is as follows. The mushroom-shaped discharge valve 7*b* is inserted in an upper portion of the body 7*a* composed of a cylindrical body having a flange portion, and a cap 7*c* is covered on the upper portion of the body so that the valve does not come off. Furthermore, a top end portion of a compression spring 7*d* as a biasing member abuts against a bottom face portion of a head of the discharge valve 7*b*, and airtight can be held by closely connecting the head of the valve which receives a biasing force of the spring with a spot facing hole 7*i* of the cap 7*c*. A bottom end portion of the compression spring 7*d* is supported by a spring supporting member 7*e* screwed in an insertion hole. In passing, strength of the biasing force of the spring 7*d* is adjustable by rotating the spring supporting member 7*e* to change a position.

As shown in the drawing, the plug body 7*a* and the cap 7*c* are fixed by a screw in the vicinity of the upper portion of the substitute stopper 7, and airtight between the body 7*a* and the cap 7*c* is held by fitting an O-ring 7*f* as a packing on an upper portion of the flange portion. As shown in FIG. 16*b*, rib portions 7*g* are formed on four places in an inside of the vicinity of a top end portion of the body 7*a*, and a head of the discharge valve 7*b* is able to move upward and downward in a state that an outer peripheral portion thereof is in contact with these four rib portions. Therefore, if the head of the discharge valve 7*b* is retracted by pressing against the biasing force with the opening B2 of the bottle B faced downward, fluid such as wine and so on in the bottle B can flow from a gap generated between the head and the spot face hole 7*i* in the cap 7*c* through spaces 7*s* formed between the rib portions. In passing, a lower portion below the flange portion of the substitute stopper 7 is to be pressed into the opening B2 of the bottle B, and therefore, an outside diameter of the portion is made smaller than a diameter of the opening of the bottle because O-rings 7*k* as seal members are disposed in an elastic deformation state.

Meanwhile, since inside diameters of the bottle opening B2 are diversified, it is difficult that a substitute stopper can correspond to all inside diameters for a cost reason. Therefore, as shown in FIG. 16*c*, in the present invention, in place of the O-rings 7*k* a substitute stopper to which seal members 107*k* made of rubber rings having a T-shaped cross section are attached on plural places of the body 107*a* is adopted, an outside diameter of the plug body being constant. The seal members 107*k* are so structured that a thick ring portion 107*r* in an inside thereof is fitted in a groove of the plug body 107*a*, and airtight can be held by transformed portions 107*m* formed in a flange shape by elongating an outer peripheral portion of the ring portion. In other words, the seal members 107*k* can correspond to a change of sizes with a wide variety of bottles by transforming the thin flange shaped portions 107*m* and by filling a gap between an inner periphery of the bottle B and an outer periphery of the plug body 107*a* when the substitute stopper 107 is pressed into the bottle opening B2. Adoption of such the substitute stopper decreases kinds of sizes of plugs, which contributes reduction of running costs of a wine bar and so on.

(Method for Changing Bottle Stopper by Stopper Change Device)

Next, a method for changing a bottle stopper using the stopper change device 10 will be explained. Basically, the method for changing the bottle stopper using the stopper change device 10 allows the bottle stopper and the substitute stopper to be changeable without deterioration in the quality of fluid by means of a process including a process of detaching the bottle stopper in the airtight container filled with deterioration preventive gas and a process of mounting the substitute stopper contained in the airtight container in place of the bottle stopper. This invention is naturally on the assumption of existence of a device such as the bottle stopper change device 10, however, it is not always limited to such a device. For example, such a case that the stopper change device itself does not require deterioration preventive gas, and that a change of stopper is conducted in a state that the entire stopper change device is contained in a sealed body filled with deterioration preventive gas is included.

First, as a first preparation of changing the bottle stopper, as shown in FIG. 1, the operation body 41 is fallen downwards by swinging the swing lever 43, and the fixing ring 16 is taken off from the gyration holding portion 15; furthermore, the gyration moving table 23 (the chamber body 21) is taken off from the holder body 11. Furthermore, existence of a remaining cork stopper used at the last time in the first airtight chamber 24*a* is confirmed, and if there is, it is removed. Next, the substitute stopper 7 is inserted in the second airtight chamber 25*a*. At this time, the press-down member 35 and the second piston 37 as the second supporting structure 34, and the slider 39 are pushed to an upper limit. Next, the gyration moving table 23 is mounted on the gyration holding portion 15, and the fixing ring 16 is fastened to fix, thereby the moving table supporting structure 14 is realized. Subsequently, as shown in FIGS. 3 and 7, the first airtight tower 24 is positioned on an upper facing position of the mounting mouth 13 as the first position, and the second airtight tower 25 is positioned on a symmetric position of a rotation center as the second position. Next, the gyration-moving table 23 is mounted to be able to turn on the gyration-holding portion (the holding portion) 15 in an airtight state via the moving table supporting structure 14. As a result, since the recessed portion 15*c* formed on an upper face of the gyration holding portion 15 is closed by a lower face of the gyration moving table 23, the gas passage 17 made of a circular space is partitioned. Next, the swing lever 43 is lifted up so as to return to a normal state where the lead screw 45 of the operation body 41 positions above the first airtight tower 24. In passing, at this time, the operation body 41 is stopped at a predetermined position by the positioning elements 43*a*.

Next, as a second preparation, the coupling assist 90 is mounted on the head B2 of the bottle B with fluid contained in it. First, in this process, a cap seal covering the opening B2 of the bottle is peeled off, and a coupling nut 91 of the coupling assist 90 is inserted so that the female screw portion faces upward, and a wide ring 93 as a packing is pressed into the head of the bottle. In passing, both operations may be simultaneously conducted because theses preparations are in a random order. Next, the stopper change device 10 prepared during the aforementioned first preparation is mounted on the opening B2 of the bottle so that the stopper change device 10 is fixed to the bottle B and mounted in an airtight state by rotating and fastening the coupling nut 91 after putting together the male screw portion 13*a* of the mounting mouth 13 and the female screw portion 91*a* of the coupling nut 91 (refer to FIGS. 3 to 5).

Next, as shown in FIG. 1, the gas hose 86 is connected to the gas supply port 19 via a hose joint, and nitrogen gas (N gas) as deterioration preventive gas is supplied from the gas bomb 85 to the inside of the chamber body 21. N gas supplied through the gas supply port 19 and the gas passage 17 is filled in the holder body 11 and the respective airtight chambers 24*a*, 25*a*, however, the airtight state is held by an airtight holding means such as the O-rings (the packing) 8. Here, by temporarily opening the air vent valve 57, air in the gas passage 17, in the first airtight chamber 24*a*, and in the second airtight chamber 25*a* is exhausted so that only the supplied deterioration preventive gas is filled. In passing, it is desired to continue supply of N gas during a process of changing the stopper even after air is exhausted.

Next, the projecting portion of the switching member 48 attached to the handle 47 is turned downward. The lead screw is lowered against frictional drag of the first supporting structure 28 by pushing down the handle and making a clockwise rotation while maintaining the handle in an integrally rotating state with the lead screw 45. At this time, since the clutch mechanism 55 is in an open state, and the lead screw 45 is free to the swing lever 43, the tip portion of the screw 27 immediately reaches the top end portion of the cork stopper C. Furthermore, at this time, the crank-shaped recessed portion 51*d* (refer to FIG. 6) provided at the bottom end portion of the connector 51 is engaged with the engaging member 29*a* provided on the upper portion of the supporting member 29 so that the screw 27 is integrally rotated clockwise with the lead screw 45. At this time, the first piston 31 constituting the first supporting structure 28 is also lowered by lowering the lead screw 45, however, the airtight in the first airtight chamber 24*a* in a range below the piston is kept by the packing 8*c* as the airtight holding means so that gas leak does not happen.

The screw 27 is thus lowered and the tip portion thereof is impaled on the top end portion of the cork stopper C through the opening B2 of the bottle. In addition, when the handle 47 is rotated clockwise while pushing it down, the screw 27 enters the cork C by a self-rotation. When the screw 27 thus enters the cork stopper C through the bottle opening B2 and reaches the vicinity of the bottom end portion of the cork stopper as shown in FIG. 8, the rotation of the lead screw 45 is stopped. Here, by changing a position of the switching member 48 attached to the handle 47 positioned at the top end portion of the lead screw, the top end portion of the lead screw is able to project from the hole portion 48*a*. This realizes a screw pair between the female screw portion 47*a* of the handle and the male screw portion 45*a* of the lead screw. When the handle 47 abuts on the upper portion of the swing lever 43 and is rotated clockwise, the lead screw 45 becomes a move screw, and is moved upward in a non-rotational state.

Figure 9:
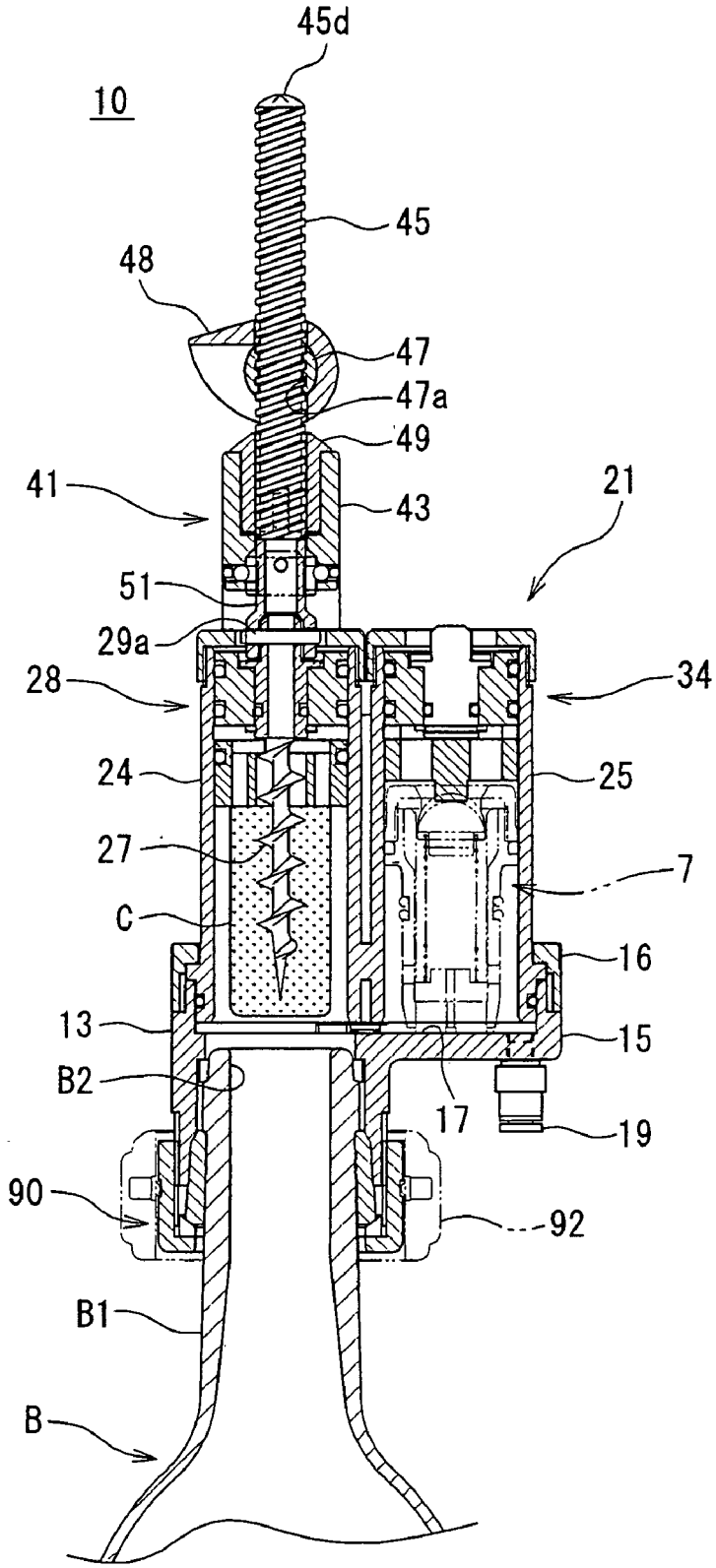
FIG. 9 is a cross sectional view showing the stopper change device of the present invention, and showing a state that the bottle-opening member of the stopper change device in FIG. 8 is moved upward and that the pulled cork stopper is contained in a first airtight chamber.
Figure 10:
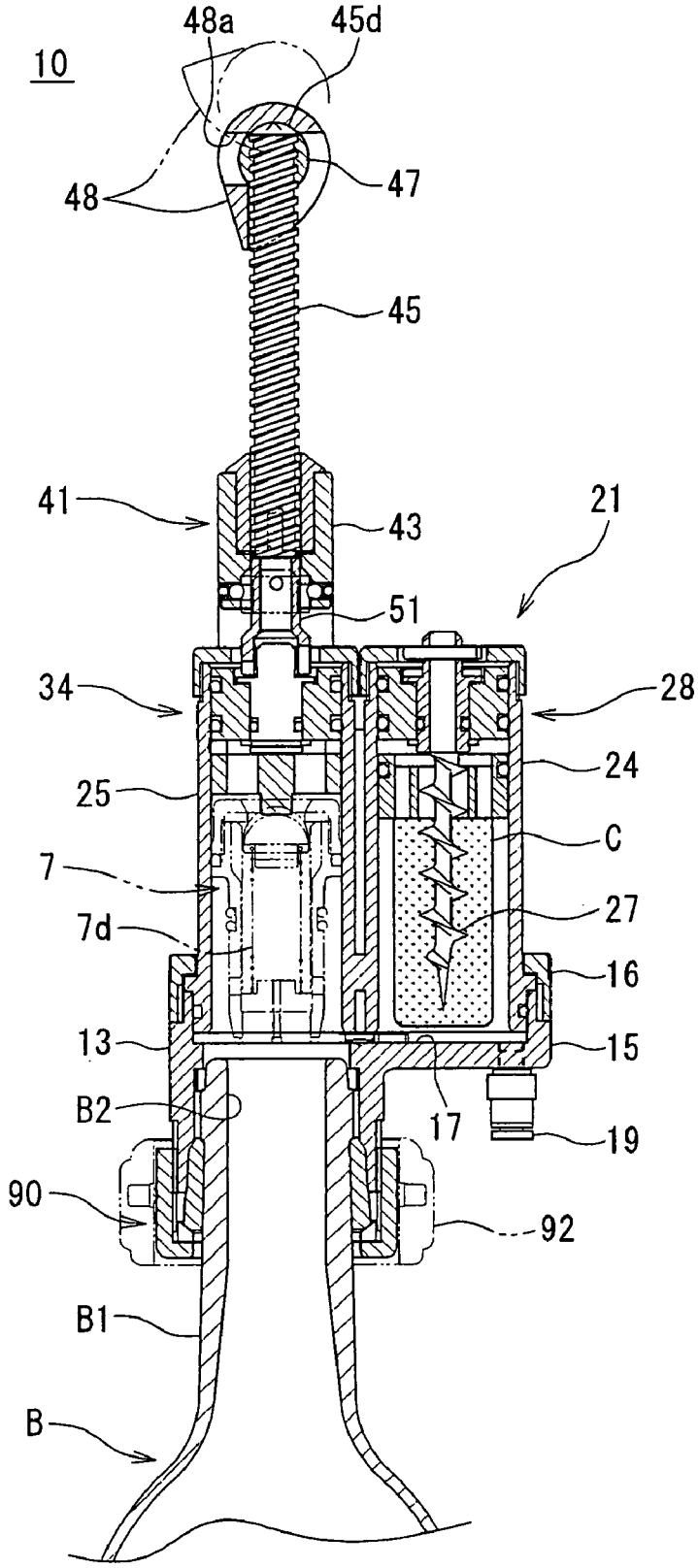
FIG. 10 is a cross sectional view showing the stopper change device of the present invention, and showing a state that a position of the first airtight chamber and a position of a second airtight chamber of the stopper change device shown in FIG. 9 are switched.

At this time also, since the crank-shaped recessed portion 51*d* (refer to FIG. 6) of the connector 51 maintains an engaging state with the engaging member 29*a* of the supporting member 29, various lowered components such as the first supporting structure 28 in the first airtight chamber 24*a* are moved toward an upper portion of the first airtight chamber. As a result, the cork stopper C is contained in the first airtight chamber 24*a* as shown in FIG. 9. At this time, the opening B2 of the bottle is in an open state. However, if N gas is continuously supplied in the bottle from the gas passage 17, the inside is in an airtight state and a pressure reduce situation is not generated, thereby deterioration in the quality of the fluid (wine) is preventable. Next, the handle 47 is rotated counter-clockwise and is moved to the top end portion of the lead screw 45, so that the position of the switching member 48 is changed and the handle 47 is fixed on the top end portion of the lead screw 45.

Subsequently, in a state that the handle is grasped with one hand and the bottle B is grasped with the other hand, as shown with the two-dot chain line in FIG. 1, the swing lever 43 is pivoted (refer to FIG. 5) on the supporting shaft 43*s* as a center. The swing lever 43 is positioned by the positioning elements 43*a* on a side of the chamber body 21, but the lever is detached against engaging force thereof so that it is fallen at a position (for example, approximately 140°) where the turn of the gyration-moving table 23 is not obstructed. Next, as shown in FIG. 7, the gyration moving table 23 is rotated at 180° in a horizontal direction on the gyration holding portion 15 so that the positions of the first airtight tower 24 and the second airtight tower 25 are changed. In other words, the second airtight chamber 25*a* is moved to the first position, and the first airtight chamber 24*a* is moved to the second position being the symmetrical position of the first position. If N gas is continuously supplied in the meantime, wine does not deteriorate because entering air in the bottle is blocked. As shown in FIGS. 3 to 5, the substitute stopper 7 is inserted in the second airtight chamber 25*a* as explained above, however the substitute stopper is positioned over the mounting mouth 13 as the first position by a positional change of the gyration moving table 23 so that the substitute stopper is in a standby state at a position where it is mountable on the head B1 of the bottle.

Subsequently, a screw pair is realized (refer to FIG. 5) between the swing lever and the lead screw 45 by pushing the push buttons 55*c*, 55*c* of the clutch mechanism 55 provided on both sides of the swing lever 43. As a result, the lead screw 45 is able to move downward by a clockwise rotation of the handle 47. Then, by the clockwise rotation of the lead screw 45 using the handle 47, the second supporting structure 34 is lowered and the substitute stopper 7 is pressed into the opening B2 of the bottle. Meanwhile, the substitute stopper 7 can be also pressed without using the clutch mechanism 55. That is, the substitute stopper 7 can be pressed into the opening B2 by pushing down the lead screw 45, which is in a free state without operating the clutch mechanism 55. Because the handle 47 must be rotated many times when the clutch mechanism 55 is used, a relatively long time is required for pressing, and on the other hand, large force is not required and operation is easy. Meanwhile, when the clutch mechanism 55 is not used, the large force is required for pushing down the lead screw compared with the case when the clutch mechanism 55 is used. On the other hand, pressing can be conducted by one push, and a quick operation can be expected. Use or non-use of the clutch mechanism 55 can be appropriately selected according to preference of a user.

Regardless of whether or not the clutch mechanism 55 is used, when the substitute stopper 7 is pressed, the bottom end portion of the connector 51 abuts on the engaging member 35*a* and pushes down the press-down member 35. The second piston 37 and the slider 39 are lowered according to pushing down of the press-down member 35. By this lowering, the lower portion of the slider 39 presses the tip portion of the substitute stopper 7 inserted in the second airtight chamber 25*a* so that the plug is lowered, and the plug is pressed into the opening B2 of the bottle. When the flange portion of the substitute stopper 7 formed in the vicinity of the upper portion abuts on the edge of the opening of the bottle, the pressing work of the substitute stopper is completed. In this state, N gas is filled in an upper space inside the bottle, and this gas is not leaked through the discharge valve 7*b* of the substitute stopper 7. Finally, the coupling nut 91 is rotated and the stopper change device 10 is taken out of the bottle B. This completes the work of changing the stopper.

By completion of the work of changing the stopper, the bottle B in which the bottle head B1 is closed by the substitute stopper 7 is obtained. Air is not contained in the bottle B and N gas is filled therein. Accordingly, oxidation of wine inside the bottle B is effectively prevented.

(Other Structure)

The above explanations were given on the assumption that fluid is wine and that deterioration preventive gas is gas-having nitrogen as a main ingredient (N gas). However, in addition, as deterioration preventive gas, carbon dioxide gas, mixed gas of nitrogen gas and carbon dioxide gas, or other gases can be adoptable. For example, when carbon dioxide gas is adopted as deterioration preventive gas for carbonated beverage, not only deterioration of the fluid can be prevented but also loss of carbon ingredients can be prevented. In addition, as the fluid, other beverages such as whisky, brandy, carbonated beverage, a nutritional supplement, a dairy product, fruit juice with pulp, condensed fluid, fluid having a large liquid resistance, and so on are acceptable. However, not only different deterioration preventive gas must be selected according to characteristics of the fluid but also a structure of a fluid extracting device must be corresponded thereto.

Figure 17:
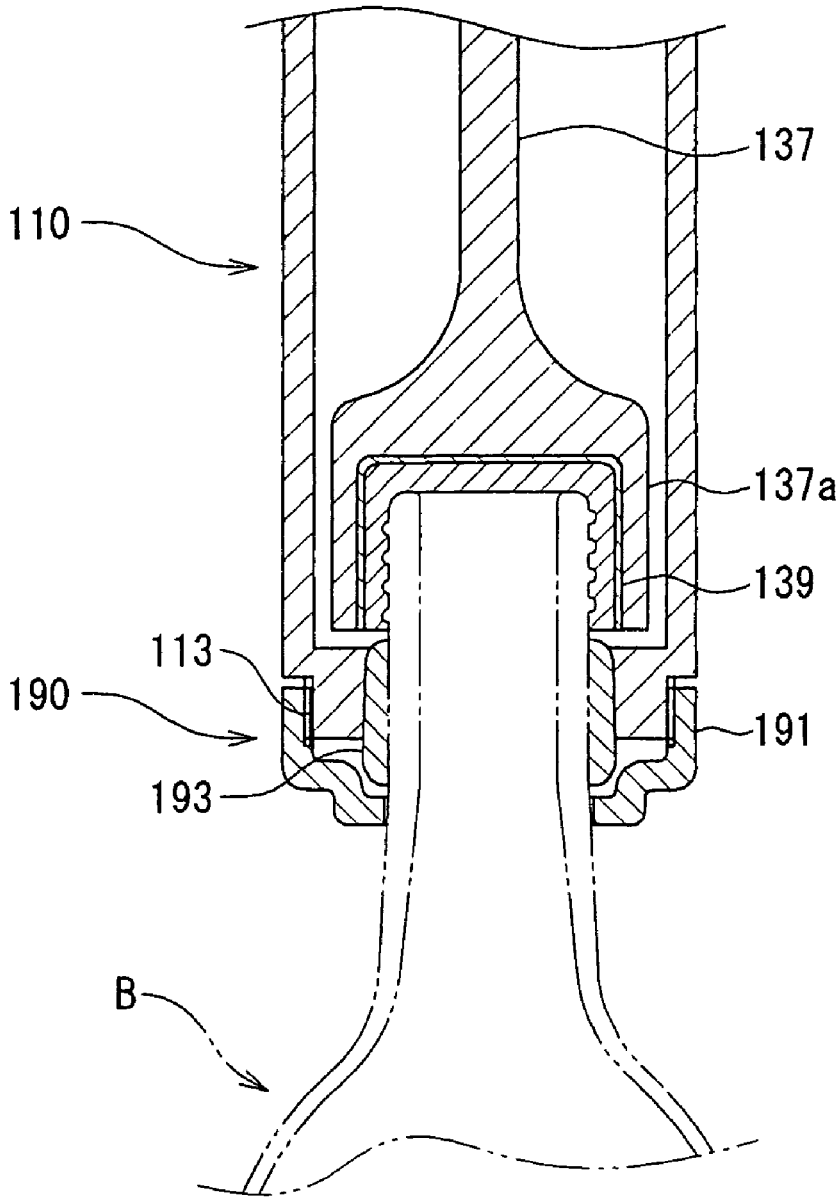
FIG. 17 is a partial sectional view showing another example of the bottle-opening member used in the present invention.

Furthermore, the above explanations were given on the assumption that the bottle stopper is a cork stopper. However, the present invention is applicable to other types of bottle stoppers such as a screw stopper in addition to the cork stopper. For example, as shown in FIG. 17, if a stopper change device for the screw stopper is used, in place of a corkscrew as a bottle opening member, a torque bar 137 having an enclosing portion similar to a box wrench, and disposing a cap-shaped elastic body 139 on an entire surface inside a box portion 137*a*, can be adopted, and the torque bar 137 can be rotated in such a manner that the aforementioned corkscrew is inserted in the cork, so that the screw stopper can be wrung off by utilizing frictional drag. In this case also, a connection between the bottle B and a stopper change device 110 is conducted by a coupling assist 190. The coupling assist 190 is so structured that a coupling nut 191 has a large diameter because a diameter of a mounting mouth 113 of the stopper change device is large. In addition, in this case, if a screw portion of the stopper is a right-hand screw, the stopper change device 110 needs to correspond thereto.

Furthermore, the above explanations were given on the assumption that an upper surface of the holder body is a circle having a recessed portion, that a moving table mounted thereon is a gyrating table, and that positions of the respective airtight chambers are changed by the turning or rotating. However, a spirit of them is not limited to the turning, and it is possible to change their positions by moving the moving table by a linear motion. In addition, the respective airtight chambers are provided in the respective airtight towers, however these airtight chambers can be provided side by side in one block. Furthermore, explanations were also given on the assumption that the operation body is provided via the swing lever supported on the holder body to be able to swing, however the operation body may be fixed or may be attachable and detachable.

According to the present invention, a device for changing a bottle stopper and a method for changing a bottle stopper capable of changing the existing bottle stopper with the substitute stopper without allowing air to enter the bottle with fluid contained therein can be provided. By changing the bottle stopper using such a device or a method, it is possible to effectively prevent the fluid remaining in a bottle once opened from deteriorating with the passage of time. Therefore, for example, if the fluid remaining in the bottle is beverage such as wine and so on, a good taste can be enjoyed for relatively a long period without worrying about oxidation of the beverage after opening the bottle.

INDUSTRIAL AVAILABILITY

As explained above, a device for changing a stopper and a method for changing a stopper of the present invention are suitable for changing an existing bottle stopper with a substitute stopper without allowing air to enter the bottle with fluid (for example, beverage such as wine and so on) contained therein.

What is claimed is:

1. A method for changing a bottle stopper of a bottle, comprising:

providing a bottle having fluid contained therein, said fluid being sealed within said bottle by a bottle stopper disposed in a neck of said bottle;

providing an airtight container having a gyration moving table with a substitute stopper disposed adjacent to said bottle stopper;

engaging said airtight container over at least a portion of said neck;

detaching said battle stopper from said neck without inserting an operator's hands within said airtight container;

rotating said gyration moving table with respect to said bottle; and mounting said substitute stopper within said neck;

wherein a deterioration preventive gas is disposed within said airtight container at least during the detaching, rotating, and mounting steps.

2. The method of claim 1, further comprising the step of:

removing air from said airtight container before providing said deterioration preventive gas to said airtight container.

3. The method of claim 2, wherein said deterioration preventive gas is provided to said airtight container during said detaching and mounting steps.

4. The method of claim 1, further comprising the steps of removing air from said airtight container and then providing said deterioration preventive gas inside said airtight container, wherein said step of providing said deterioration preventive gas is performed at least during said detaching and mounting steps.

5. A method for changing a bottle stopper of a bottle, comprising:

providing a bottle with a neck, providing a bottle stopper within at least a portion of said neck;

providing an airtight container comprising a substitute stopper;

engaging said airtight container around said neck of said bottle, said airtight container covering said bottle stopper; said airtight container forming a seal with a surface of said neck;

providing said airtight container with a gas;

removing said bottle stopper from said neck portion; and mounting said substitute stopper within at least a portion of said neck;

wherein said airtight container comprises a flexible bag.

6. The method of claim 5, wherein said sealed bottle comprises a quantity of liquid and said gas has a composition that will not deteriorate said liquid.

7. The method of claim 6, wherein said liquid comprises wine and said gas comprises nitrogen.

8. The method of claim 5, further comprising the step of continuing to provide said gas to said airtight container during the steps of removing said bottle stopper and mounting said substitute stopper.

9. The method of claim 5, further comprising the step of removing air from inside said airtight container prior to providing said airtight container with said gas.

10. The method of claim 9, wherein said airtight container has a vent port for removing air from inside said airtight container and a gas inlet port for receiving a flow of said gas within the airtight container.

11. The method of claim 5, wherein said flexible bag contains a cork screw and said substitute stopper, said cork screw being operable by a user grasping said flexible bag to remove said bottle stopper from said neck, said substitute stopper being operable by a user grasping said flexible bag to mount said stopper within at least a portion of said neck.

12. A method for changing a bottle stopper of a bottle, comprising:

providing a bottle having a hollow neck, providing a bottle stopper within at least a portion of said hollow neck;

providing an airtight container comprising a gyration moving table with a substitute stopper disposed adjacent to said bottle stopper;

engaging said airtight container to an outside surface of said bottle, said airtight container covering said bottle stopper, said airtight container being filled with a first gas;

providing said airtight container with a second gas;

removing said bottle stopper from said hollow neck without inserting an operator's hands and manipulating within said airtight container;

rotating said gyration moving table with respect to said bottle; and mounting said substitute stopper within at least a portion of said hollow neck.

13. The method of claim 12, wherein said airtight container further has a vent, and step of providing said airtight container with a second gas further comprises venting said first gas out of said airtight container via said vent.

14. The method of claim 12, wherein said airtight container comprises a bottle stopper removing portion and a substitute stopper mounting portion, said bottle stopper removing portion comprising a bottle stopper engaging element and said substitute stopper mounting portion having a substitute stopper engaging surface, wherein when said airtight container is engaged with said outside surface of said bottle, the gyration moving table is rotatable between a bottle stopper removing position and a substitute stopper mounting position.

15. The method of claim 14, wherein when said airtight container is in said bottle stopper removing position, said bottle stopper engaging element is located directly adjacent to said bottle stopper.

16. The method of claim 15, wherein when said airtight container is in said substitute stopper mounting position, said substitute stopper mounting portion is positioned directly adjacent said hollow neck.

17. The method of claim 15, wherein said step of removing said bottle stopper from said hollow neck comprises positioning said airtight container in said bottle stopper removing position, and engaging said bottle stopper with said bottle stopper removing element.

18. The method of claim 17, wherein said step of mounting said substitute stopper comprises positioning said airtight container in said substitute stopper mounting position, and engaging said substitute stopper with said hollow neck.

19. The method of claim 12, wherein said first gas comprises air and said second gas comprises nitrogen.

* * * * *